US007044835B2

(12) United States Patent
Mujumdar et al.

(10) Patent No.: US 7,044,835 B2
(45) Date of Patent: May 16, 2006

(54) ABRASIVE ARTICLE AND METHODS FOR GRINDING GLASS

(75) Inventors: Ashutosh N. Mujumdar, Woodbury, MN (US); Todd J. Christianson, Oakdale, MN (US); Mark G. Schwabel, Lake Elmo, MN (US)

(73) Assignee: 3M Innovaive Properties Company, St. Paul, MN (US)

( * ) Notice: Subject to any disclaimer, the term of this patent is extended or adjusted under 35 U.S.C. 154(b) by 355 days.

(21) Appl. No.: 10/284,692

(22) Filed: Oct. 31, 2002

(65) Prior Publication Data

US 2003/0181144 A1 Sep. 25, 2003

Related U.S. Application Data

(62) Division of application No. 09/560,596, filed on Apr. 28, 2000.

(51) Int. Cl.
*B24B 1/00* (2006.01)

(52) U.S. Cl. ..... 451/41; 451/28; 451/42

(58) Field of Classification Search ..... 451/28, 451/41–43, 527, 461, 541, 542, 546, 547, 451/460, 539, 534; 51/295
See application file for complete search history.

(56) References Cited

U.S. PATENT DOCUMENTS

| | | | | |
|---|---|---|---|---|
| 4,255,164 | A | | 3/1981 | Butzke et al. |
| 4,311,489 | A | | 1/1982 | Kressner |
| 4,576,612 | A | | 3/1986 | Shukla et al. |
| 4,609,581 | A | | 9/1986 | Ott |
| 4,644,703 | A | | 2/1987 | Kaczmarek et al. |
| 4,652,274 | A | | 3/1987 | Boettcher et al. |
| 4,652,275 | A | | 3/1987 | Bloecher et al. |
| 4,733,502 | A | | 3/1988 | Braun |
| 4,735,632 | A | | 4/1988 | Oxman et al. |
| 4,751,138 | A | | 6/1988 | Tumey et al. |
| 4,799,939 | A | | 1/1989 | Bloecher et al. |
| 4,903,440 | A | | 2/1990 | Kirk et al. |
| 5,014,468 | A | | 5/1991 | Ravipati et al. |
| 5,152,917 | A | | 10/1992 | Pieper et al. |
| 5,236,472 | A | | 8/1993 | Kirk et al. |
| 5,254,194 | A | | 10/1993 | Ott et al. |
| 5,256,170 | A | | 10/1993 | Harmer et al. |
| 5,368,619 | A | | 11/1994 | Culler |
| 4,773,920 | A | | 5/1995 | Chasman et al. |
| 5,435,816 | A | | 7/1995 | Spurgeon et al. |
| 5,505,747 | A | | 4/1996 | Chesley et al. |
| 5,542,876 | A | * | 8/1996 | Field, Jr. ..... 451/540 |
| 5,580,647 | A | | 12/1996 | Larson et al. |
| 5,632,668 | A | * | 5/1997 | Lindholm et al. ..... 451/42 |
| 5,681,217 | A | | 10/1997 | Hoopman et al. |
| 5,733,178 | A | * | 3/1998 | Ohishi ..... 451/41 |
| 5,853,319 | A | * | 12/1998 | Meyer ..... 451/548 |
| 5,888,119 | A | * | 3/1999 | Christianson et al. ..... 451/41 |
| 6,354,929 | B1 | * | 3/2002 | Adefris et al. ..... 451/527 |

FOREIGN PATENT DOCUMENTS

| | | |
|---|---|---|
| WO | WO 98/39142 | 9/1998 |
| WO | WO 99/42250 | 8/1999 |
| WO | WO 00/64630 | 11/2000 |
| WO | WO 00/64631 | 11/2000 |

* cited by examiner

*Primary Examiner*—George Nguyen

(57) ABSTRACT

The present invention is a fixed abrasive article for grinding or polishing the surface of a glass workpiece. The abrasive article for grinding glass has abrasive composites containing agglomerates having diamond particles, and optionally other abrasive particles. The abrasive composites are integrally molded to a backing. The abrasive articles, when used to grind glass, provides a high stock removal rate but provides a smooth surface finish. Lubricant can be used to improve the grinding characteristics of the abrasive article.

16 Claims, 5 Drawing Sheets

ABRASIVE ARTICLE AND METHODS FOR GRINDING GLASS

This application is a divisional application of U.S. patent application Ser. No. 09/560,596, filed on Apr. 28, 2000.

FIELD OF THE INVENTION

The present invention pertains to an abrasive article for grinding and polishing glass, and a method of using the same.

BACKGROUND OF THE INVENTION

Glass articles are extensively found in homes, offices, and factories in the form of lenses, prisms, mirrors, CRT screens, and other items. Many of these glass surfaces are used with optical components which require that the surface be optically clear and have no visible defects and/or imperfections. If present, defects, imperfections, and even minute scratches may inhibit the optical clarity of the glass article. In some instances, these defects, imperfections, and/or minute scratches may inhibit the ability to accurately see through the glass. Glass surfaces used with optical components must be essentially free of any defect, imperfection, and/or scratch.

Many glass surfaces are curved or contain a radius associated therewith. These radii and curves are generally generated in the glass forming process. However, as a result of the glass forming process, defects such as mold lines, rough surfaces, small points, and other small imperfections may be present on the outer surface of the glass. These defects and/or imperfections, however small, tend to affect the optical clarity of the glass. Abrasive finishing processes have been widely used to remove such imperfections and/or defects. The abrasive finishing typically falls within three main processes: grinding, fining, and polishing.

Glass finishing is typically done with a loose abrasive slurry. The loose abrasive slurry comprises a plurality of abrasive particles dispersed in a liquid medium such as water. The most common abrasive particles used for loose slurries are pumice, silicon carbide, aluminum oxide, garnet, and the like. The loose abrasive slurry may optionally contain other additives such as dispersants, lubricants, defoamers, and the like. In most instances, the loose abrasive slurry is pumped between the glass surface that is being finished and a lap pad, such that the loose abrasive slurry is present between the glass surface and the lap pad. The lap pad may be made from any material such as rubber, foam, polymeric material, metal, steel, and the like. Typically, both the glass workpiece and the lap pad will rotate relative to each other. This process typically comprises one or more steps, with each step generating a progressively finer surface finish on the glass.

Rough grinding steps perfect the desired curve or radius and remove any casting defects by rough grinding the glass surface with an abrasive system that includes a metal-button lap used with a rough slurry of aluminum oxide or garnet. However, the abrasive tool in this rough grinding process will impart coarse scratches into the glass surface such that resulting glass surface is neither precise enough nor smooth enough to directly polish to an optically clear state. The objective of the grinding process is to remove large amounts of glass quickly and fairly accurately while leaving as fine of a scratch pattern as feasible. These scratches are then typically removed by further steps commonly known as "fining" and "polishing", which use finer slurries and softer pads.

The roughness of a surface is typically due to scratches or a scratch pattern, which may or may not be visible to the naked eye. A scratch pattern may be defined as a series of peaks and valleys along the surface. Rtm and Ra are common measures of roughness used in the abrasives industry, however, the exact measuring procedure may vary with the type of equipment utilized in surface roughness evaluation.

Ra is defined as an average roughness height value of an arithmetic average of the departures of the surface roughness profile from a mean line on the surface. Generally, the lower the Ra value, the smoother the finish. Measurements are taken at points both above and below the mean line on the surface within an assessment length set by the measurement instrument. Ra and Rtm (defined below) are measured with a profilometer probe, which is a 5 micrometer radius diamond tipped stylus and the results are recorded in micrometers (μm). These departure measurements are totaled and then divided by the number of measurements to arrive at an average value.

Rt is defined as the maximum peak-to-valley height. Rtm is the average, measured over five consecutive assessment lengths, of the maximum peak-to-valley height in each assessment length. In general, the lower the Rtm value, the smoother the finish. A slight variation in the Ra and Rtm values may, but not necessarily, occur when the measurement on the same finished glass surface is performed on different brands of commercially available profilometers.

The final step of the overall finishing process is the polishing step which generates the smoother, optically clear surface on the glass article. In most instances, this polishing step is done with a loose abrasive slurry, since the loose slurry typically generates an optically clear surface that is essentially free of any defects, imperfections, and/or minute scratches. Typically, the loose abrasive slurry comprises ceria abrasive particles dispersed in water.

Although loose abrasive slurries are widely utilized in the fining and polishing steps to provide an optically clear surface finish on glass articles, loose abrasive slurries have many disadvantages associated with them. These disadvantages include the inconvenience of handling the required large volume of the slurry, the required agitation to prevent settling of the abrasive particles and to assure a uniform concentration of abrasive particles at the polishing interface, and the need for additional equipment to prepare, handle, and dispose of or recover and recycle the loose abrasive slurry. Additionally, the slurry itself must be periodically analyzed to assure its quality and dispersion stability which requires additional costly man hours. Furthermore, pump heads, valves, feed lines, grinding laps, and other parts of the slurry supply equipment which contact the loose abrasive slurry eventually show undesirable wear. Further, the steps which use the slurry are usually very untidy because the loose abrasive slurry, which is a viscous liquid, splatters easily and is difficult to contain.

Understandably, attempts have been made to replace the loose abrasive slurry finishing steps with lapping, coated, or fixed abrasive products. In general, a lapping abrasive comprises a backing having an abrasive coating comprising a plurality of abrasive particles dispersed in a binder. For example, U.S. Pat. Nos. 4,255,164; 4,576,612; 4,733,502; and European Patent Application No. 650,803 disclose various fixed abrasive articles and polishing processes. Other references that disclose fixed abrasive articles include U.S. Pat. Nos. 4,644,703; 4,773,920; and 5,014,468.

However, fixed abrasives have not completely replaced loose abrasive slurries. In some instances the fixed abrasives do not provide a surface which is optically clear and essentially free of defects, imperfections, and/or minute scratches. In other instances, the fixed abrasives require a longer time to polish the glass article, thereby making it more cost effective to use a loose abrasive slurry. Similarly in some instances, the life of a fixed abrasive is not sufficiently long to justify the higher cost associated with the fixed abrasive in comparison to loose abrasive slurries. Thus, in some instances, fixed abrasives are not as economically desirable as loose abrasive slurries.

What is desired by the glass industry is an abrasive article that does not exhibit the disadvantages associated with a loose abrasive slurry, but that is able to effectively and economically grind a glass surface in a reasonable time by providing fast stock removal.

BRIEF SUMMARY OF THE INVENTION

One aspect of the invention is directed to abrasive articles for grinding and polishing glass workpieces. The abrasive article includes a backing and at least one three-dimensional abrasive coating comprising abrasive agglomerates having diamond particles dispersed within a permanent binder, preferably a glass binder; the agglomerates are dispersed within an organic binder integrally bonded to the backing. In one preferred abrasive article, the organic binder in which the agglomerates are dispersed is an epoxy binder.

It is preferred that the at least one three-dimensional abrasive coating includes a plurality of abrasive composites. The plurality of abrasive composites may be precisely shaped composites, irregularly shaped composites, or precisely shaped composites including a cylinder or any other post-shape having a flat top.

The agglomerates within the abrasive article include diamond particles, which may be blended with other non-diamond hard abrasive particles, soft inorganic abrasive particles, and mixtures thereof. In one embodiment, it is preferred to provide agglomerates with a mixture of diamond abrasive particles and aluminum oxide particles. In one preferred embodiment, the agglomerates have about 6 to 30 parts diamonds, about 12 to 40 parts aluminum oxide, and about 30 to 82 parts of glass binder. Individual abrasive particles, such as diamond particles, can be included in the organic resin together with the agglomerates.

The diamond abrasive particles are present in the abrasive composite at a weight percent of about 15% to 50%, preferably about 30% to 40%, more preferably about 20% to 35%

In one embodiment of the invention, an abrasive article having agglomerates with 50 micrometer diamond particles removes at least 30 micrometers of glass per second and leaves an average surface finish no greater than about 0.9 micrometer Ra.

In another embodiment of the invention, an abrasive article having agglomerates with 25 micrometer diamond particles removes at least 15 micrometers of glass per second and leaves an average surface finish no greater than about 0.65 micrometer Ra.

In yet another embodiment of the invention, an abrasive article having agglomerates with 20 micrometer diamond particles removes at least 12 micrometers of glass per second and leaves an average surface finish no greater than about 0.5 micrometer Ra.

In a further embodiment of the invention, an abrasive article having agglomerates with 15 micrometer diamond particles removes at least 10 micrometers of glass per second and leaves an average surface finish no greater than about 0.4 micrometer Ra.

In yet a further embodiment of the invention, an abrasive article having agglomerates with 6 micrometer diamond particles removes at least 3 micrometers of glass per second and leaves an average surface finish no greater than about 0.2 Ra.

In some embodiments, it has been found that using a lubricant, such as an oil-based emulsion, is preferred over using water as a coolant at the grinding interface. The use of a lubricant during the grinding of the glass surface can increase the cut rate, provide a finer finish, decrease the amount of wear on the abrasive article or extend the useful life of the abrasive article over and beyond the results achieved when using water.

The RPP Test Procedure

Some of the test data disclosed herein was tested using this RPP Test Procedure.

The "RPP" procedure utilizes a "Buehler Ecomet 4" variable speed grinder-polisher on which is mounted a "Buehler Ecomet 2" power head, both of which are commercially available from Buehler Industries, Ltd. of Lake Bluff, Ill. The test is typically performed using the following conditions: motor speed set at 500 rpm with a force 60 lbs. (267 N), which provides an interface pressure of about 25.5 psi (about 180 kPa) over the surface area of the glass test blank. The interface pressure may be increased or decreased for testing under varied conditions.

Three flat circular glass test blanks are provided which have a 2.54 cm (1 inch) diameter and a thickness of approximately 1.0 cm, commercially available under the trade designation "CORNING #9061", commercially available from Corning Incorporated, Corning, N.Y.

The glass material is placed into the power head of the grinder-polisher. The 12-inch (30.5 cm) aluminum platform of the grinder-polisher rotates counter clockwise while the power head, into which the glass test blank is secured, rotates clockwise at 35 rpm.

An abrasive article to be tested is die cut to a 20.3 cm (8 inch) diameter circle and is adhered with a pressure sensitive adhesive directly onto an extruded slab stock foam urethane backing pad which has a Shore A hardness of about 65 durometer. The urethane backing pad is attached to an extruded slab open cell, soft foam pad having a thickness of about 30 mm. This pad assembly is placed on the aluminum platform of the grinder/polisher. Tap water is sprayed onto the abrasive article at a flow rate of approximately 3 liters/minute to provide lubrication between the surface of the abrasive article and the glass test blank.

An initial surface finish on the glass test blank is evaluated with a diamond stylus profilometer, commercially available under the trade designation "SURTRONIC 3", commercially available from Taylor Hobson, Leicester, England. An initial thickness and weight of the glass test blank is also recorded.

The glass test blank is ground using the grinder described above. The grinding time interval of the grinder is set at 10 seconds. However, real time contact between the abrasive article and the glass test blank surface may be greater than the set time because the grinder will not begin timing until the abrasive article is stabilized on the glass test blank surface. That is, there may be some bouncing or skipping of the abrasive article on the glass surface and the grinder begins timing at the point when contact between the abrasive article and the glass surface is substantially constant. Thus, real time grinding interval, that is the contact between the abrasive article and the glass surface, is about 12 seconds.

After grinding, final surface finish and a final weight or thickness are each recorded.

It will be understood that the actual time (rate) necessary to grind an actual glass workpiece to the desired specification will vary depending upon a number of factors, such as the polishing apparatus used, the backing pad under the abrasive article, the speed of the abrasive rotation, the size of the surface area to be polished, the contact pressure, the abrasive particle size, the amount of glass to be removed, and the initial condition of the surface to be ground, etc. The RPP procedure above simply provides a baseline performance characteristic that may be used to compare the article and the method according to the invention with conventional glass grinding techniques.

The CPP Test Procedure

Some of the test data disclosed herein was tested using this CPP Test Procedure.

The CPP test procedure utilizes a custom made rotary polisher commonly used in the manufacturing of CRT screens. The test is performed using actual CRT screens (diagonal about 43 cm (about 17 inches)). The screen is placed in the screen holder mounted on a plate which rotates counterclockwise at 45 rpm. When placed in the holder, the surface of the screen to be polished faces up.

The abrasive article to be tested is approximately 53.5 cm (21 inches) in diameter and abrasive posts that extend up to about 24 cm (9½ inches) from the center of the abrasive article. The center 7.6 cm (3 inch) portion of the abrasive article has no abrasive posts. The center also has a 3.2 cm (1.25 inch) hole to allow for a hollow bolt to be inserted that will attach the abrasive article to the dome and allow for the coolant to be pumped to the center of the abrasive article during the polishing application. The abrasive article is attached to rubber backup material (shore A value of 20) using a hook and loop attachment system. The backup material is then attached to a curved dome using pressure sensitive adhesive. In addition, a center bolt is used to firmly secure the abrasive article and the rubber backup assembly to the dome. The dome has a curvature of 1400 mm which is close to the curvature of the CRT screen used in the test procedure. The dome is mounted on the polisher using six bolts with the abrasive article facing the CRT screen. The dome is positioned such that its center is 75 mm offset to the center of the screen and it is tilted 3.4 degrees with respect to the horizontal position. This provides best matching of the screen and the abrasive article considering the curved nature of the surface to be polished.

The test is performed using the following conditions—Screen speed of 45 rpm in the counterclockwise direction, abrasive article speed of 700 rpm in the clockwise direction, and total force of 1350 lb which provides average interfacial pressure of 11 psi over the surface area of the screen. The interfacial pressure may be increased or decreased for testing under various conditions.

Before the test begins, the weight and the surface roughness of the screen is recorded. The surface finish (Ra, Rmax) is recorded using a diamond stylus profilometer, under the trade designation "PERTHOMETER" available from Mahr Corporation. A coolant, at a flow rate of approximately 6 gal/min (20 liters/min) is pumped from the center of the abrasive article to provide lubrication between the surface of the abrasive article and the glass surface. With the abrasive and the screens rotating at the desired speeds, the abrasive article is lowered and brought in contact with the glass surface. The grinding time interval of the grinder is set at 30 seconds. After grinding, the surface finish and the final weight of the screen is recorded.

It should be understood that the actual time (rate) necessary to grind an actual CRT screen to the desired specification will vary depending upon a number of factors, such as the polishing apparatus used, the backing pad under the abrasive article, the speed of abrasive article rotation, the size of the surface to be polished, the contact pressure, the abrasive particle, size, the type of lubricant used and the initial conditions of the surface to be ground. The CPP procedure above simply provides a baseline performance characteristics that may be used to compare the article and the method according to the invention with conventional glass grinding techniques.

DETAILED DESCRIPTION OF THE INVENTION

The present invention pertains to articles and methods of finishing, that is, grinding and polishing glass surfaces with an abrasive article that has a backing and at least one three-dimensional abrasive coating preferably comprising diamond, agglomerates comprising diamond particles, or ceria particles dispersed within a binder bonded to a surface of the backing. The abrasive coating comprises a binder formed from a binder precursor and a plurality of abrasive particles or abrasive agglomerates, preferably diamond or ceria abrasive particles or agglomerates comprising diamond particles, or combinations thereof.

The end use of the glass may be in a home or commercial environment and may be used for decorative purposes or structural purposes. The glass will have at least one finished surface. The glass may be relatively flat or it may have some contour associated with it. These contours may be in the shape of curves or corners. Examples of glass surfaces or workpieces include parts of optical components such as lenses, prisms, mirrors, CRT (cathode ray tube) screens, and the like. CRT screens are found extensively in display surfaces used in devices such as television sets, computer monitors, and the like. CRT screens range in size (as measured along the diagonal) of about 10 cm (4 inches) to about 100 cm (40 inches) or more. CRT screens have an outer surface that is convex and there is a radius of curvature.

Figure 1:
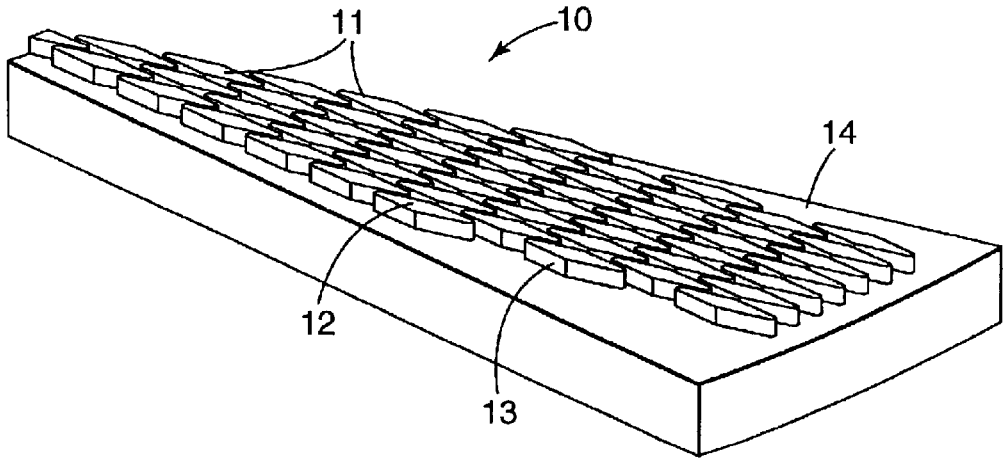
FIG. 1 is a perspective view of one embodiment of an abrasive article according to the present invention.
Figure 2:
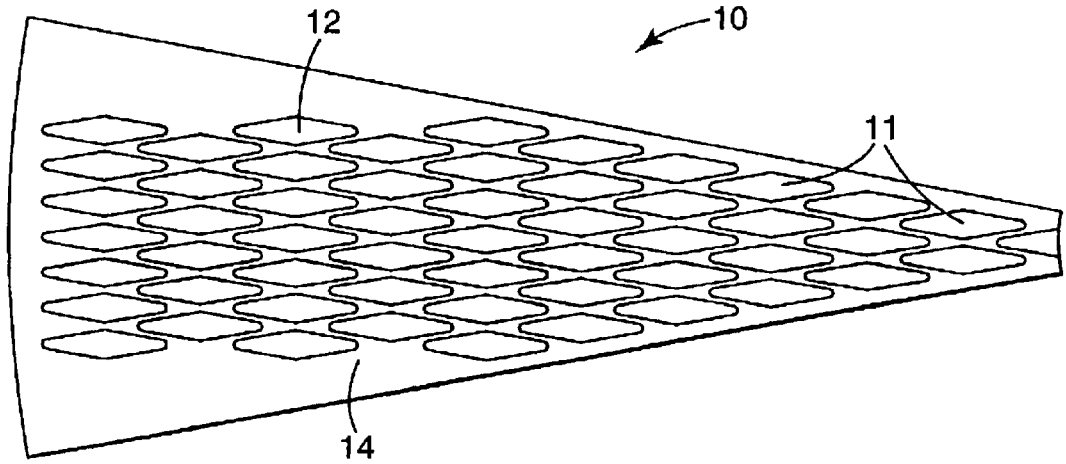
FIG. 2 is a top view of the abrasive article of FIG. 1.

Referring now to the Figures, one embodiment of an abrasive article 10 in accordance with the invention is illustrated in FIGS. 1 and 2. FIG. 1 is a perspective view of abrasive article 10 which includes an integrally molded backing 14 bearing on one major surface thereof a plurality of abrasive composites 11. Composites 11 are diamond-shaped and have a distal end or top surface 12 and a base 13.

Abrasive composites 11 comprise a plurality of abrasive particles dispersed in an organic binder. The abrasive particles may be a mixture of different abrasive materials. Composites 11 are integrally molded with backing 14 along base 13. In almost all instances, backing 14 will be visible as land areas between composites 11. Composites 11 comprise organic resin and abrasive particles and any additional optional additives such as fillers, pigments, coupling agents, etc.

FIG. 2 is a top view of abrasive article 10, again showing composites 11 having top surface 12 on backing 14. Composites 11 may be located on the entire surface of backing 14, or a portion of backing 14 may be left uncovered by composites as shown in FIG. 2. Composites 11 are symmetrically and orderly disposed on backing 14.

It is preferred that bases 13 of adjacent abrasive composites be separated from one another by backing or land area 14. This separation allows, in part, the fluid medium to freely flow between the abrasive composites. This free flow of the fluid medium tends to contribute to a better cut rate surface finish or increased flatness during glass grinding. The spacing of the abrasive composites may vary from about 0.3 abrasive composite per linear cm to about 100 abrasive composite per linear cm, preferably about 0.4 to about 20 abrasive composite per linear cm, more preferably about 0.5 to 10 abrasive composite per linear cm, and even more preferably about 0.6 to 3.0 abrasive composites per linear cm. In one aspect of the abrasive article, there are at least about 5 composites/$cm^2$ and preferably at least 100 composites/$cm^2$. In a further embodiment of the invention, the area spacing of composites ranges from about 1 to 12,000 composites/$cm^2$.

Figure 3:
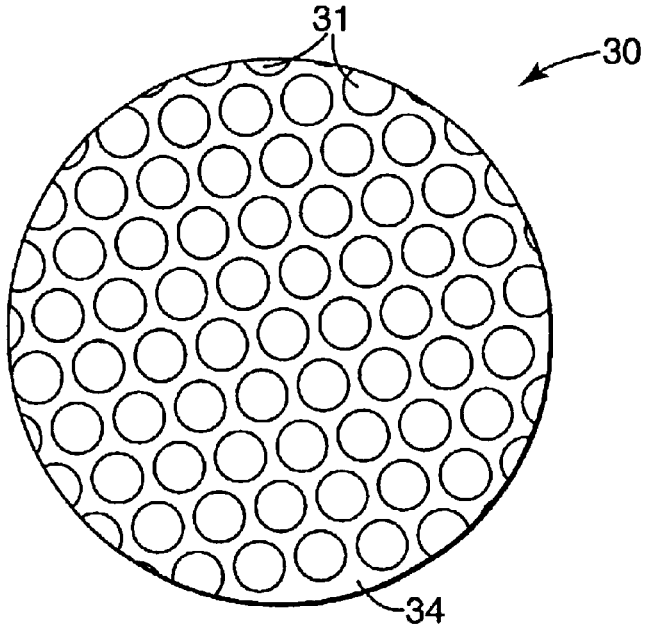
FIG. 3 is a top view of another embodiment of an abrasive article according to the present invention.

One preferred shape of the abrasive composites is generally a cylindrical post, as shown in FIG. 3; FIG. 3 is a top view of abrasive article 30 having circular abrasive composites 31. Backing 34 may be seen between composites 31. In FIG. 3, the entire surface of backing 34 (exclusive of any land area between composites) is covered by composites 31. It is preferred that the height of the abrasive composites 31 is constant across the abrasive article 30, but it is possible to have abrasive composites of varying heights. The height of the composites may be a value from about 10 micrometers to about 25,000 micrometers (2.5 cm), preferably about 25 to about 15,000 micrometers, more preferably from about 100 to about 10,000 micrometers, and even more preferably from about 1,000 to about 8,000 micrometers. The diameter of the composites, at least for a cylindrical post composite, may be a value from about 1,000 to 25,000 micrometers (1.0 mm to 2.5 cm), preferably 5,000 to 20,000 micrometers. A particularly preferred topography includes cylindrical posts having a height of about 9,500 micrometers (0.95 cm) with a base diameter of about 15,900 micrometers (1.59 cm). There are approximately 3,200 micrometers between the bases of adjacent posts. Another preferred topography includes cylindrical posts having a height of about 6,300 micrometers (0.63 cm) and a base diameter about 7,900 micrometers (0.79 cm). There are approximately 2,400 micrometers between the bases of adjacent posts.

Figure 4:
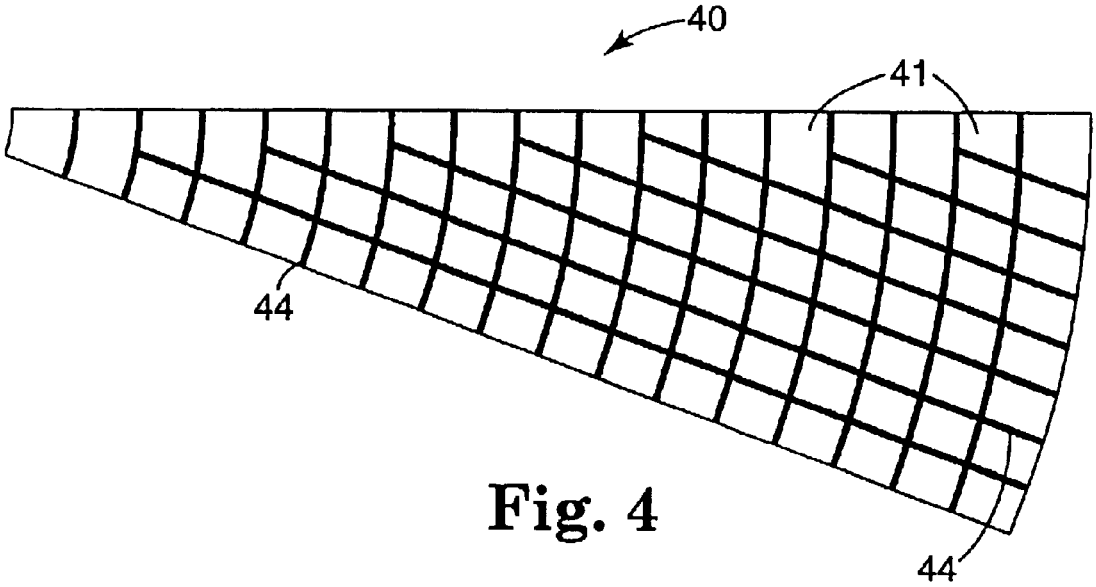
FIG. 4 is a top view of yet a third embodiment of an abrasive article according to the present invention.

FIG. 4 is a top view of a wedge or pie-shaped abrasive article 40. Composites 41 are arranged in arcuate sections with land areas 44 between the composites. Composites 41 are not identical in shape or size.

In some applications it may be desired to include a metal bonded segment within an abrasive composite to increase the grinding ability of the resulting abrasive article. The segment, for example, may be electroplated, hot pressed, sintered, or made by any other known method. Abrasive particles, for example diamond particles, may be randomly dispersed throughout the segment or may be precisely spaced. The abrasive particles may be situated in layers or homogeneously dispersed throughout the segment. Examples of metal bonded abrasive segments are taught in U.S. patent application Ser. No. 08/984,899, filed Dec. 4, 1997. The segment may completely fit within the side edges of the abrasive composite, that is, it does not extend above the top surface or beyond the side wall of the composite. Segments bonded by glass or vitrified bond, a ceramic, or a glass-ceramic bond can also be used.

Figure 5:
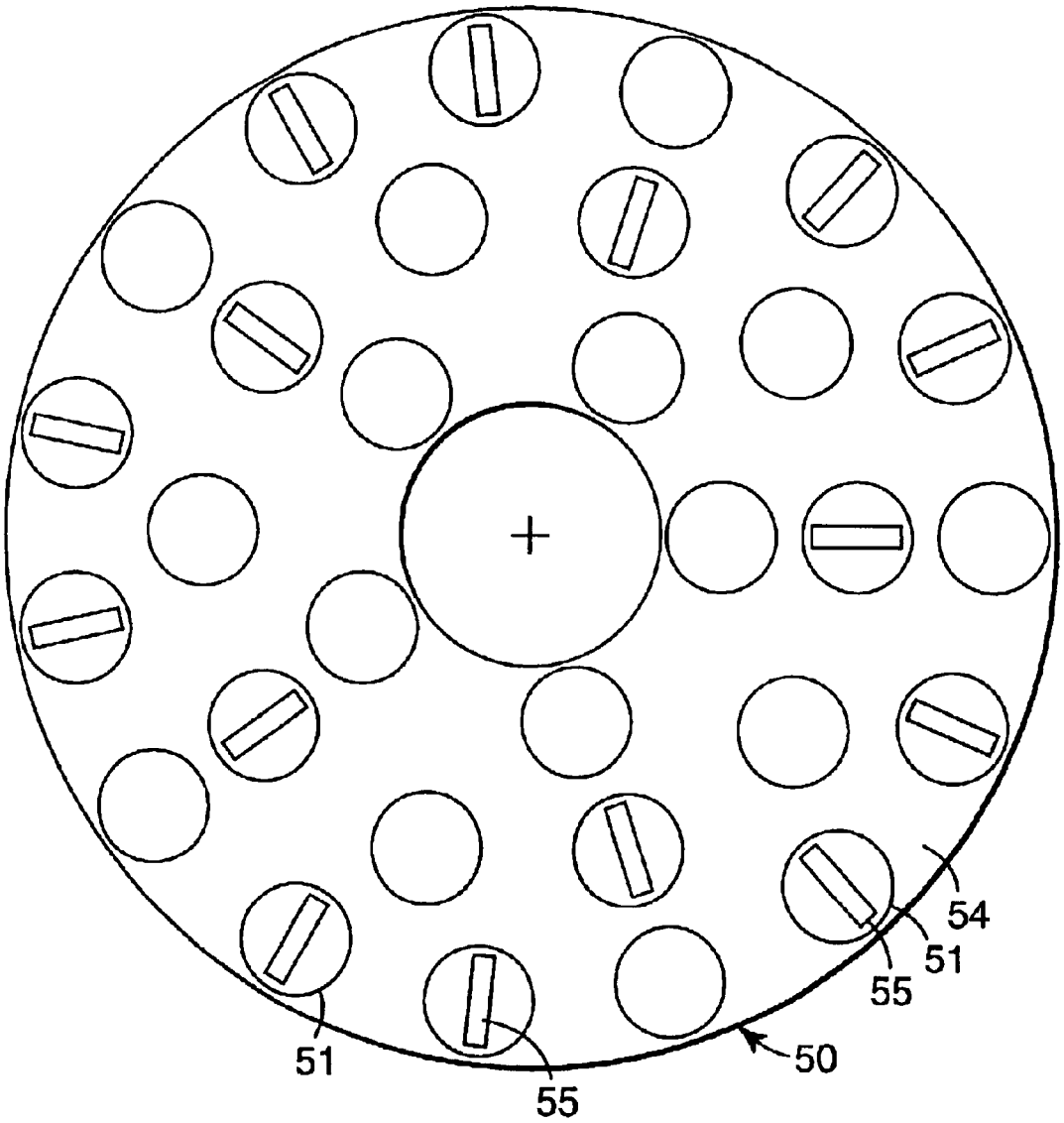
FIG. 5 is a top view of a fourth embodiment of an abrasive article according to the present invention.

FIG. 5 is a top view of abrasive article 50 which has abrasive composites 51 on backing 54. A portion of abrasive composites 51 have a metal bonded abrasive segment 55 embedded therein.

Figure 6A:
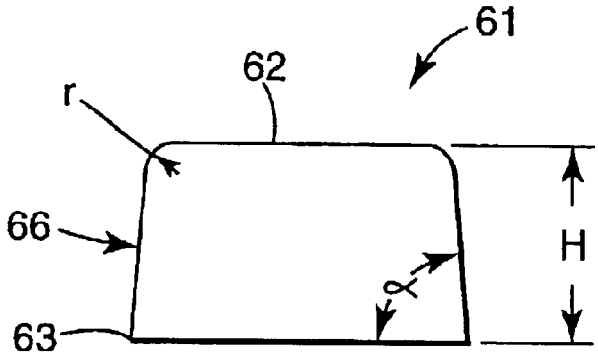
FIG. 6A is a side view of an abrasive composite of the present invention.
Figure 6B:
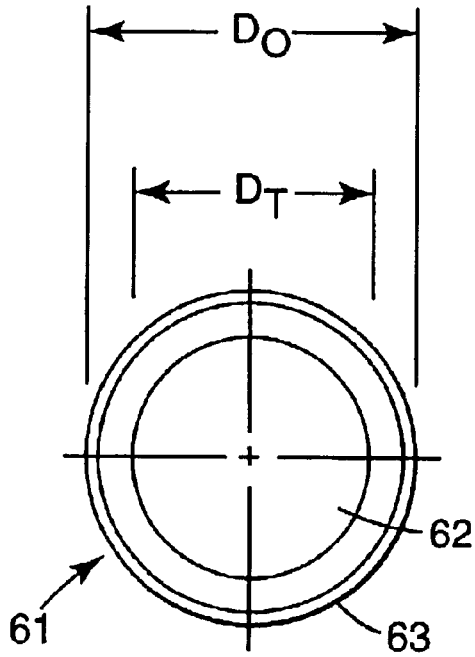
FIG. 6B is a top view of the abrasive composite of FIG. 6A.

FIGS. 6A and 6B show composite 61 in side and top views, respectively. FIG. 6A shows composite 61 having base 63 which is adjacent the backing (not shown) and top surface 62. Composite 61 has height H. Generally, the height of composites is about 10 micrometers to about 30,000 micrometers (2.5 cm), preferably about 25 to about 15,000 micrometers, more preferably from about 100 to about 10,000 micrometers. In some embodiments, it may be desirable for composite 61 to be of a slightly tapered shaped, for example a pyramid or a cone. FIG. 6A shows composite 61 having an internal angle $\alpha$, between base 63 and side wall 66, which defines the taper of composite 61. Angle $\alpha$ may range from 90° (that is, there is no taper to the composite) to about 45°. Preferably angle $\alpha$ is 75° to 89.90°, more preferably 80° to 89.70°, and even more preferably 80° to 87°. It is theorized that a tapered composite may aid in the controlled break-down of the composite during use, and it also aids in removal of the composite from the tooling used for molding the composite. Also in FIG. 6A is shown radius r, which is the internal radius of the corner where side wall 66 meets top surface 62. It is generally preferred to have a slightly rounded or radiused corner because it is believed that a rounded corner is easier to thoroughly fill with material (that is, resin and abrasive particles) and remove from the tooling.

FIG. 6B is a top view of composite 61. Base 63 has a diameter $D_O$ which is greater than diameter $D_\tau$ of top surface 62. For a circular composite such as 61, $D_O$ may be about 1,000 micrometers to about 25,000 micrometers (2.5 cm). Likewise, $D_\tau$ may be about 500 micrometers to about 50,000 micrometers. For any other cross-section shape, such as a square, rectangle, triangle, star, etc., the diameter of the composite is the difference between $D_O$ and $D_\tau$ is determined by the taper of composite 61 (directly related to angle $\alpha$) and by the height H.

The abrasive composites have a discernible shape, and can be any geometric shape, such as a cubic, block-like, cylindrical, prismatic, rectangular, pyramidal, truncated pyramidal, conical, truncated conical, cross, or post-like with a top surface which is flat. A hemispherical shape is described in U.S. Pat. No. 5,681,217. The abrasive article can have a mixture of different abrasive composite shapes. It is foreseen that the cross section shape of the base of the composite can be different than the top surface. For example, the base of the abrasive composite could be square while the top surface is circular.

The bases of the abrasive composites may abut one another or the bases of adjacent abrasive composites may be separated from one another. It is to be understood that this definition of abutting also covers an arrangement where adjacent composites share a common abrasive land material or bridge-like structure which contacts and extends between facing sidewalls of the composites. The abrasive land material is generally formed from the same abrasive slurry used to form the abrasive composites or from the slurry used to form the backing.

The abrasive articles shown in FIGS. 1, 2, and 4 are designed to be used with a plurality of such articles. These pie- or wedge-shaped articles are generally arranged on a back-up pad to complete a 360° circle. This circle of abrasive articles is then used to grind glass workpieces such as TV and CRT screens. Alternately, only one of an article such as shown in FIGS. 3 and 5 need be arranged on a back-up pad to cover the entire back-up pad.

At least 20% of the surface area of the backing will be covered by abrasive composites, and typically no greater than about 90% of the surface area will be covered. Depending on the exact grinding process, the grinding may occur over the entire abrasive article or may be concentrated more in one area than another.

A. Binders

The binder of the abrasive composite, which binds multiple agglomerates together, is formed from a binder precursor, which is a resin that is in an uncured or unpolymerized state. During the manufacture of the abrasive article, the binder precursor is polymerized or cured, su that a binder is formed. The binder precursor can be a condensation curable resin, an addition polymerizable resin, a free radical curable resin, and/or combinations and blends of such resins.

One preferred binder precursor is a resin or resin mixture that polymerizes via a free radical mechanism. The polymerization process is initiated by exposing the binder precursor, along with an appropriate catalyst, to an energy source such as thermal energy or radiation energy. Examples of radiation energy include electron beam, ultraviolet light, or visible light.

Examples of free radical curable resins include acrylated urethanes, acrylated epoxies, acrylated polyesters, ethylenically unsaturated monomers, aminoplast monomers having pendant unsaturated carbonyl groups, isocyanurate monomers having at least one pendant acrylate group, isocyanate monomers having at least one pendant acrylate group, and mixtures and combinations thereof. The term acrylate encompasses acrylates and methacrylates.

One preferred binder precursor comprises a urethane acrylate oligomer, or a blend of a urethane acrylate oligomer and an ethylenically unsaturated monomer. The preferred ethylenically unsaturated monomers are monofunctional acrylate monomers, difunctional acrylate monomers, trifinctional acrylate monomers, or combinations thereof. The binder formed from these binder precursors provides the abrasive article with its desired properties. In particular, these binders provide a tough, durable, and long lasting medium to securely hold the abrasive particles throughout the life of the abrasive article. This binder chemistry is especially useful when used with diamond abrasive particles because diamond abrasive particles last substantially longer than most conventional abrasive particles. In order to take full advantage of the long life associated with diamond abrasive particles, a tough and durable binder is desired. Thus, this combination of urethane acrylate oligomer or blend of urethane acrylate oligomer with an acrylate monomer and diamond abrasive particles provides an abrasive coating that is long lasting and durable.

Examples of acrylated urethanes include those known by the trade designations "PHOTOMER" (for example, "PHOTOMER 6010"), commercially available from Henkel Corp., Hoboken, N.J.; "EBECRYL 220" (hexafunctional aromatic urethane acrylate of molecular weight 1,000), "EBECRYL 284" (aliphatic urethane diacrylate of 1,200 molecular weight diluted with 1,6-hexanediol diacrylate), "EBECRYL 4827" (aromatic urethane diacrylate of 1,600 molecular weight), "EBECRYL 4830" (aliphatic urethane diacrylate of 1,200 molecular weigh diluted with tetraethylene glycol diacrylate), "EBECR YL 6602" (trifunctional aromatic urethane acrylate of 1,300 molecular weight diluted with trimethylolpropane ethoxy triacrylate), and "EBECRYL 840" (aliphatic urethane diacrylate of 1,000 molecular weight), commercially available from UCB Radcure Inc., Smyrna, Ga.; "SARTOMER" (for example, "SARTOMER 9635, 9645, 9655, 963-B80, 966-A80", etc.), commercially available from Sartomer Company, West Chester, Pa.; and "UVITHANE" (for example, "UVITHANE 782"), commercially available from Morton International, Chicago, Ill.

The ethylenically unsaturated monomers or oligomers, or acrylate monomers or oligomers, may be monofunctional, difunctional, trifunctional or tetrafunctional, or even higher functionality. The term acrylate includes both acrylates and methacrylates. Ethylenically unsaturated binder precursors include both monomeric and polymeric compounds that contain atoms of carbon, hydrogen, and oxygen, and optionally, nitrogen and the halogens. Ethylenically unsaturated monomers or oligomers preferably have a molecular weight of less than about 4,000, and are preferably esters made from the reaction of compounds containing aliphatic monohydroxy groups or aliphatic polyhydroxy groups and unsaturated carboxylic acids, such as acrylic acid, methacrylic acid, itaconic acid, crotonic acid, isocrotonic acid, maleic acid, and the like. Representative examples of ethylenically unsaturated monomers include methyl methacrylate, ethyl methacrylate, styrene, divinylbenzene, hydroxy ethyl acrylate, hydroxy ethyl methacrylate, hydroxy propyl acrylate, hydroxy propyl methacrylate, hydroxy butyl acrylate, hydroxy butyl methacrylate, vinyl toluene, ethylene glycol diacrylate, polyethylene glycol diacrylate, ethylene glycol dimethacrylate, hexanediol diacrylate, triethylene glycol diacrylate, trimethylolpropane triacrylate, glycerol triacrylate, pentaerythritol triacrylate, pentaerythritol trimethacrylate, pentaerythritol tetraacrylate and pentaerythritol tetramethacrylate. Other ethylenically unsaturated monomers or oligomers include monoallyl, polyallyl, and polymethallyl esters and amides of carboxylic acids, such as diallyl phthalate, diallyl adipate, and N,N-diallyladipamide. Still other nitrogen containing compounds include tris(2-acryl-oxyethyl)isocyanurate, 1,3,5-tri(2-methacryloxyethyl)-s-triazine, acrylamide, methylacrylamide, N-methyl-acrylamide, N,N-dimethylacrylamide, N-vinyl-pyrrolidone, and N-vinylpiperidone, and "CMD 3700", commercially available from Radcure Specialties. Examples of ethylenically unsaturated diluents or monomers may be found in U.S. Pat. Nos. 5,236,472 and 5,580,647.

In general, the ratio between these acrylate monomers depends upon the weight percent of diamond abrasive particles and any optional additives or fillers desired in the final abrasive article. Typically, these acrylate monomers range from about 5 parts by weight to about 95 parts by weight urethane acrylate oligomer to about 5 parts by weight to about 95 parts by weight ethylenically unsaturated monomer. Additional information concerning other potential useful binders and binder precursors is found in PCT WO 97/11484 and U.S. Pat. No. 4,773,920.

Acrylated epoxies are diacrylate esters of epoxy resins, such as the diacrylate esters of bisphenol A epoxy resin. Examples of acrylated epoxies include "CMD 3500", "CMD 3600", and "CMD 3700", all commercially available from Radcure Specialties; and "CN103", "CN104", "CN111", "CN112", and "CN114", all commercially available from Sartomer Company.

Examples of polyester acrylates include "PHOTOMER 5007" and "PHOTOMER 5018", commercially available from Henkel Corporation.

Aminoplast monomers have at least one pendant alpha, beta-unsaturated carbonyl group. These unsaturated carbonyl groups may be acrylate, methacrylate or acrylamide type groups. Examples of such materials include N-(hydroxymethyl)-acrylamide, N,N'-oxydimethylenebisacrylamide, ortho and para acrylamidomethylated phenol, acrylamidomethylated phenolic novolac, and combinations thereof. These materials are further described in U.S. Pat. Nos. 4,903,440 and 5,236,472.

Isocyanurates having at least one pendant acrylate group and isocyanate derivatives having at least one pendant acrylate group are further described in U.S. Pat. No. 4,652,274. The preferred isocyanurate material is a triacrylate of tris(hydroxy ethyl) isocyanurate.

Depending upon how the free radical curable resin is cured or polymerized, the binder precursor may further comprise a curing agent, (which is also known as a catalyst or initiator). When the curing agent is exposed to the appropriate energy source, it will generate a free radical source that will start the polymerization process.

Another preferred binder precursor comprises an epoxy resin. Epoxy resins have an oxirane ring and are polymerized by a ring opening reaction. Such epoxide resins include monomeric epoxy resins and polymeric epoxy reins. Examples of preferred epoxy resins include 2,2-bis-4-(2,3-epoxypropoxy)-phenylpropane, a diglycidyl ether of bisphenol, which include "EPON 828", "EPON 1004", and "EPON 1001F", commercially available from Shell Chemical Co., Houston, Tex., and "DER-331", "DER-332", and "DER-334", commercially available from Dow Chemical Co, Midland, Mich. Other suitable epoxy resins include cycloaliphatic epoxies, glycidyl ethers of phenol formaldehyde novolac (for example, "DEN-431 " and "DEN-428"), commercially available from Dow Chemical Co. Examples of usable multi-functional epoxy resins are "MY 500", "MY 510", "MY 720" and "Tactix 742", all commercially available from Ciba Specialty Chemicals, Brewster, N.Y., and "EPON HPT 1076" and "EPON 1031" from Shell. The blend of free radical curable resins and epoxy resins are further described in U.S. Pat. Nos. 4,751,138 and 5,256,170.

It is preferred that any of the binder materials, when incorporated with the abrasive particles in the abrasive article, have high thermal resistance. Specifically, the cured binder preferably has a glass transition temperate (i.e., Tg) at least 150° C., preferably at least 160° C. In some embodiments, a Tg of at least 175° C. is desired. A Tg as high as 200° C. may be preferred in some embodiments. Large amounts of heat are generated during the grinding process; the abrasive article, in particular the binder, should be able to withstand the grinding temperatures with minimal degradation. High temperature resistance in epoxies is generally understood; see for example, *High Performance Polymers and Composites,* pp. 258–318, ed Jacqueline I. Kroschwitz, 1991. Generally, multi-functional epoxies provide high thermal resistance.

B. Backing Materials

Backings serve the function of providing a support for the abrasive composites. The backing should be capable of adhering to the binder after exposure of binder precursor to curing conditions, and be strong and durable so that the resulting abrasive article is long lasting. Further, the backing should be sufficiently flexible so that the articles used in the inventive method may conform to surface contours, radii, and irregularities in the glass.

The backing may be a polymeric film, paper, vulcanized fiber, a molded or cast elastomer, a treated nonwoven backing, or a treated cloth. Examples of polymeric film include polyester film, co-polyester film, polyimide film, polyamide film, and the like. A nonwoven, including paper, may be saturated with either a thermosetting or thermoplastic material to provide the necessary properties. Any of the above backing materials may further include additives such as: fillers, fibers, dyes, pigments, wetting agents, coupling agents, plasticizers, and the like. The backing can also contain a reinforcing scrim or cloth, for example, a cloth of NOMEX™, available from DuPont Company, Wilmington, Del.

In some instances it is preferable to have an integrally molded backing; that is, a backing directly molded adjacent the composites instead of independently attaching the composites to a backing such as, for example, a cloth. The backing may be molded or cast onto the back of the composites after the composites are molded, or molded or cast simultaneously with the composites. The backing can be molded from either thermal or radiation curable thermoplastic or thermosetting resins. Examples of typical and preferred thermosetting resins include phenolic resins, aminoplast resins, urethane resins, epoxy resins, ethylenically unsaturated resins, acrylated isocyanurate resins, urea-formaldehyde resins, isocyanurate resins, acrylated urethane resins, acrylated epoxy resins, bismaleimide resins, and mixtures thereof. Examples of preferred thermoplastic resins include polyamide resins (for example, nylon), polyester resins and polyurethane resins (including polyurethane-urea resins). One preferred thermoplastic resin is a polyurethane derived from the reaction product of a polyester polyol or polyether polyol and an isocyanate. The backing chemistry can be identical or is similar to the composite chemistry.

C. Abrasive Particles

The abrasive articles according to the invention also include a plurality of abrasive particles. These abrasive particles may be present as individual abrasive particles, agglomerates of a single type of abrasive particle or a combination of abrasive particles, or combinations thereon.

The abrasive particles preferably have an average particle size of about 0.01 micrometer (small particles) to 500 micrometers (large particles), more preferably about 0.25 micrometers to about 500 micrometers, even more preferably about 3 micrometers to about 400 micrometers, and most preferably about 5 micrometers to about 50 micrometers. Occasionally, abrasive particle sizes are reported as "mesh" or "grade", both of which are commonly known abrasive particle sizing methods.

It is preferred that the abrasive particles have a Mohs hardness of at least 8, more preferably at least 9. Examples of such abrasive particles include fused aluminum oxide, ceramic aluminum oxide, heated treated aluminum oxide, silicon carbide, diamond (natural and synthetic), cubic boron nitride, and combinations thereof. Softer abrasive particles, such as garnet, iron oxide, alumina zirconia, mullite, and ceria, can also be used. The abrasive particle may further comprise a surface treatment or coating, such as a coupling agent or metal or ceramic coatings.

Figure 7:
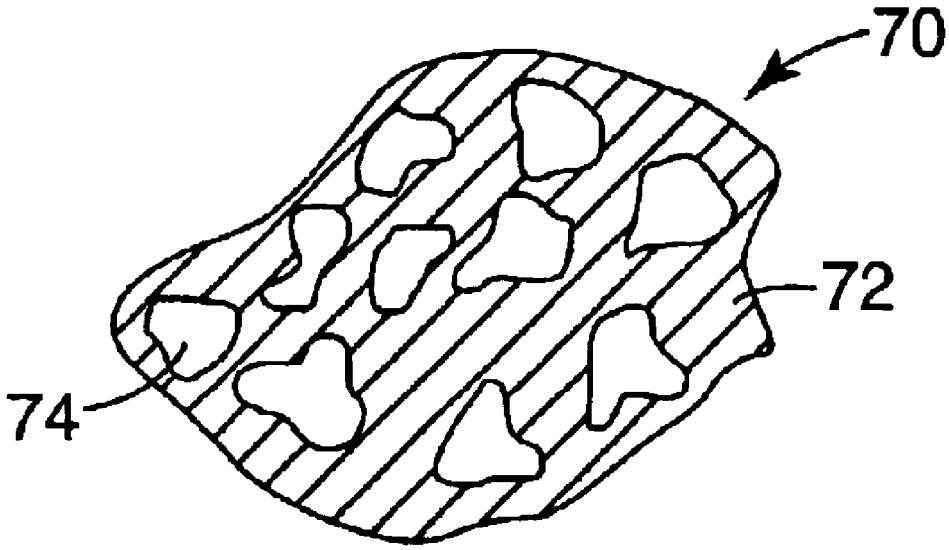
FIG. 7 is a representation in cross-section of an agglomerate according to the present invention.

An example of an abrasive agglomerate is illustrated in FIG. 7. Abrasive agglomerate 70 comprises individual abrasive particles 74 dispersed within and held together by a permanent binder 72. Preferably, abrasive particles 74 are individual diamond particles. Individual abrasive particles used in agglomerates typically have a size ranging from about 0.25 to about 100 micrometers. The permanent binder 72 may be glass, ceramic, metal, or an organic binder as described above, and is typically present in a ratio of about 1:4 to 4:1 abrasive particles:binder. In some embodiments, an approximately equal amount of the particles and binder is preferred. A preferred permanent binder is "SP1086" glass powder, commercially available from Specialty Glass Inc., Oldsmar, Fla. The agglomerate may include non-abrasive or filler particles. Abrasive agglomerates are further described in U.S. Pat. Nos. 4,311,489; 4,652,275; and 4,799,939.

Generally, the average size of the agglomerate particle, which comprises individual particles such as diamond particles, ranges from about 20 micrometers to about 1000. Often, if the individual abrasive particles within the agglomerates are about 15 micrometers or greater, the overall agglomerate is typically about 100 to about 1000 micrometers, preferably about 100 to about 400 micrometers and more preferably about 210 to about 360 micrometers. However, when the individual abrasive particles have an average size of about 15 micrometers or less, the overall agglomerate is often about 20 to about 450 micrometers, preferably about 40 to about 400 micrometers and more preferably about 70 to about 300 micrometers.

The abrasive particles used in the agglomerates can be any known abrasive particle, such as those listed above. Further, a mixture of two or more types of abrasive particles maybe used in the agglomerates. The mixtures of abrasive particles may be present in equal ratios, may have significantly more of a first type of abrasive particle that another type, or have any combination of the different abrasive particles. Mixed abrasive particles may or may not have the same average particle size or the same particle size distribution.

One example of a preferred agglomerate is an agglomerate having a mixture of diamond abrasive particles and aluminum oxide abrasive particles homogeneously throughout the agglomerate. The mixture of the abrasive particles is approximately 1:4 diamond:aluminum oxide. A glass binder, in an amount approximately equal to the weight of the abrasive particles, is used to provide the structure to the agglomerate.

For glass grinding, it is preferred that the abrasive article use diamond abrasive particles or abrasive agglomerates that include diamonds. These diamond abrasive particles may be natural or synthetically made diamond and may be considered "resin bond diamonds", "saw blade grade diamonds", or "metal bond diamonds". The single diamonds may have a blocky shape associated with them, or alternatively, a needle like shape. The single diamond particles may contain a surface coating such as a metal coating (for example, nickel, aluminum, copper or the like), an inorganic coating (for example, silica), or an organic coating. The abrasive article of the invention may contain a blend of diamond with other abrasive particles. For glass polishing, it is preferred that the abrasive article use ceria abrasive particles.

The three-dimensional abrasive coating, that is, the abrasive composites, mean have by weight about 0.1 part abrasive particles to 99 parts abrasive particles, and 1 part binder to 99.9 parts binder, where the term "binder" includes any fillers and/or other additives other than the abrasive particles. When agglomerates of individual abrasive particles are used in the abrasive coating, either the amount of the individual abrasive particles or the amount of agglomerates may be disclosed.

The preferred amount of abrasive particles in the abrasive coating is dependent on the overall abrasive article construction and the process in which it is used. For example, when the abrasive construction is used in a glass polishing application that uses tap water during the process, a particularly useful range of diamond abrasive particles is 1 to 3 weight percent of diamonds in the abrasive composite coating; if agglomerates having 50% diamond particles are used, this would correspond to an agglomerate range of about 2 to 6% in the abrasive coating. If the abrasive article contains ceria particles as the primary abrasive in the abrasive composites, the ceria particles are preferably present in an amount of from 1 to 95 parts by weight and more preferably, from 10 to 95 parts by weight with the balance being binder.

In an embodiment where a lubricant such as a mineral oil emulsion is used, the abrasive coating preferably comprises about 1 to 50 parts abrasive particles and about 50 to 99 parts binder by weight, and even more preferably comprises about 5 to 40 parts abrasive particles and about 60 to 95 parts binder by weight; if agglomerates having 50 wt-% abrasive particles are used, this would correspond to a preferable agglomerate range of 2 to 100 parts, more preferably 10 to 80 parts agglomerates.

In another embodiment, the abrasive coating preferably comprises about 15–50 parts abrasive particles, more preferably 30–40 parts abrasive particles, even more preferably about 20–35 parts abrasive particles, and most preferably about 30–35 parts; if agglomerates having 50 wt-% abrasive particles are used, this would correspond to agglomerate ranges of 30–100 parts, 60–80 parts, 40–70 parts, and 60–70 parts agglomerates in the abrasive coating.

It is believed that an abrasive coating having only agglomerates, with no binder present other than that bonding the agglomerates together, may be feasible. In such an embodiment, the abrasive coating would be held together by the binder used in the agglomerates. Such an abrasive coating can be made by heating the agglomerates to a temperature that would soften the binder to allow it to slightly flow and bond to multiple agglomerates, without loosing the structure of the agglomerates. For example, if a glass binder is used in the agglomerates, the agglomerates would be heated to a temperature sufficient to have the glass binder soften and wick to adjacent agglomerates. After cooling, the agglomerates would form an abrasive coating.

An example of a preferred abrasive coating includes both agglomerates and individual diamond abrasive particles dispersed throughout the organic binder resin. The agglomerates have a 1:4:5 ratio of diamond particles:aluminum oxide particles:glass binder. The agglomerates occupy approximately 66% by weight of the entire abrasive coating, an additional 5% of the abrasive coating is occupied by individual diamond particles, and the remainder of the coating is organic binder.

An example of a preferred abrasive coating to use in combination with "K-40" lubricant, commercially available from LOH Optical, is a coating comprising 66% agglomerates and 34% binder, where the agglomerates are 50% diamond particles having an average particles size of 25 micrometers and 50% glass binder.

Procedure to Make Abrasive Agglomerates

Diamond agglomerates can be made by mixing together a temporary binder, a permanent binder (for example, glass, ceramic, metal), and the single abrasive particles with a sufficient amount of a solvent to wet the ingredients to make a moldable paste. Any pore formers, either temporary (e.g., sacrificial) or permanent, can be added to the paste.

However, if the permanent binder is an organic binder, a temporary binder is not required. The moldable paste is placed into a suitable mold, dried, and the hardened agglomerates are removed. The agglomerates can be separated into individual agglomerates using a classification means such as a screen, and fired in either air, an inert atmosphere, or a reducing atmosphere to produce the final, dried agglomerates. In the case of an organic permanent binder, the particles are not fired, but treated in a manner to cure the organic binder.

One method of producing abrasive agglomerates uses a production tool or mold containing a plurality of cavities. These cavities are essentially the inverse shape of the desired abrasive composites and are responsible for generating the shape and placement of the abrasive composites. These cavities may have any geometric shape such as a cylinder, dome, pyramid, rectangle, truncated pyramid, prism, cube, cone, truncated cone, or any shape having a top surface cross-section being a triangle, square, circle, rectangle, hexagon, octagon, or the like.

The abrasive slurry can be coated into the cavities of the mold by any conventional technique such as die coating, vacuum die coating, spraying, roll coating, transfer coating, knife coating, and the like. If the mold has cavities that have flat tops or relatively straight side walls, it is preferred to use a vacuum system during coating to minimize air entrapment.

The mold may be a belt, a sheet, a continuous sheet or web, a coating roll such as a rotogravure roll, a sleeve mounted on a coating roll, or die and may be composed of metal, including a nickel-plated surface, metal alloys, ceramic, or plastic. Further information on production tools, their production, materials, etc. may be found in U.S. Pat. Nos. 5,152,917 and 5,435,816.

When the abrasive slurry includes a thermosetting binder precursor, the binder precursor is generally cured or polymerized by initial exposure to an energy source. Radiation energy is one preferred energy source. The radiation energy sources include electron beam, ultraviolet light, or visible light.

Other details on the use of a production tool to make abrasive agglomerates is further described in U.S. Pat. No. 5,152,917, where the coated abrasive article that is produced is an inverse replica of the production tool, and U.S. Pat. No. 5,435,816.

D. Additives

The abrasive agglomerates, abrasive coating and the backings of this invention can have additives, such as abrasive particle surface modification additives, coupling agents, fillers, expanding agents, fibers, pore formers, antistatic agents, curing agents, suspending agents, photosensitizers, lubricants, wetting agents, surfactants, pigments, dyes, UV stabilizers, and anti-oxidants. The amounts of these materials are selected to provide the properties desired.

A coupling agent may provide an association bridge between the binder and the abrasive particles, and any filler particles. Examples of coupling agents include silanes, titanates, and zircoaluminates. The coupling agent can be added directly to the binder precursor, which may have about 0 to 30%, preferably 0.1 to 25% by weight coupling agent. Alternatively, the coupling agent can be applied to the surface of any particles, typically about 0 to 3% by weight coupling agent, based upon the weight of the particle and the coupling agent. Examples of commercially available coupling agents include "A174" and "A1230", commercially available from OSi Specialties, Danbury, Conn. Still another example of a commercial coupling agent is an isopropyl triisosteroyl titanate, commercially available from Kenrich Petrochemicals, Bayonne, N.J., under the trade designation "KR-TTS".

The abrasive agglomerates or abrasive coating may further optionally comprise filler particles. Fillers generally have an average particle size range of 0.1 to 50 micrometers, typically 1 to 30 micrometers. Examples of useful fillers for this invention include: metal carbonates (such as calcium carbonate-chalk, calcite, marl, travertine, marble, and limestone; calcium magnesium carbonate, sodium carbonate, and magnesium carbonate), silica (such as quartz, glass beads, glass bubbles, and glass fibers), silicates (such as talc, clays-montmorillonite; feldspar, mica, calcium silicate, calcium metasilicate, sodium aluminosilicate, sodium silicate, lithium silicate, and hydrous and anhydrous potassium silicate), metal sulfates (such as calcium sulfate, barium sulfate, sodium sulfate, aluminum sodium sulfate, aluminum sulfate), gypsum, vermiculite, wood flour, aluminum trihydrate, carbon black, metal oxides (such as calcium oxide-lime; aluminum oxide; tin oxide—for example, stannic oxide; titanium dioxide) and metal sulfites (such as calcium sulfite), thermoplastic particles (such as polycarbonate, polyetherimide, polyester, polyethylene, polysulfone, polystyrene, acrylonitrile-butadiene-styrene block copolymer, polypropylene, acetal polymers, polyurethanes, nylon particles) and thermosetting particles (such as phenolic bubbles, phenolic beads, polyurethane foam particles), and the like. The filler may also be a salt such as a halide salt. Examples of halide salts include sodium chloride, potassium cryolite, sodium cryolite, ammonium chloride, potassium tetrafluoroborate, sodium tetrafluoroborate, silicon fluorides, potassium chloride, and magnesium chloride. Examples of metal fillers include, tin, lead, bismuth, cobalt, antimony, cadmium, iron titanium. Other miscellaneous fillers include sulfur, organic sulfur compounds, graphite, and metallic sulfides.

Either of the agglomerates, or abrasive coating, or both may include fillers or other materials that are pore formers. Pores may be desired for constructions where a quick agglomerate or coating break-down is desired. Examples of pore formers include organic materials that are sacrificed; for example, organic materials can be used to occupy volume in the agglomerate or abrasive coating, and then are removed, for example, by burning or dissolving. Examples of sacrificial pore formers are styrene balls and dextrin powder. Pores may also be formed by permanent pore formers, such as glass or alumina hollow beads or bubbles, or by foamed inorganic materials.

An example of a suspending agent is an amorphous silica particle having a surface area less than 150 meters square/gram, commercially available from DeGussa Corp., Ridgefield Park. N.J., under the trade designation "OX-50". The addition of the suspending agent may lower the overall viscosity of the abrasive slurry. The use of suspending agents is further described in U.S. Pat. No. 5,368,619.

It may be desirable in some embodiments to form an abrasive slurry which has controllable settling of the abrasive particles. As an example, it may be possible to form an abrasive slurry having diamond abrasive particles homogeneously mixed throughout. After casting or molding the composites and backing from the slurry, the diamond particles may settle out at a controlled rate so that by the time the organic resin has hardened to the point where the diamond particles may no longer settle, the diamond particles have departed from the backing and are located only in the composites.

The binder precursor may further comprise a curing agent. A curing agent is a material that helps to initiate and complete the polymerization or crosslinking process such that the binder precursor is converted into a binder. The term curing agent encompasses initiators, photoinitiators, catalysts and activators. The amount and type of the curing agent will depend largely on the chemistry of the binder precursor.

Polymerization of ethylenically unsaturated monomer(s) or oligomer(s) occurs via a free-radical mechanism. If the energy source is an electron beam, or ionizing radiation source (gamma or x-ray), free-radicals which initiate polymerization are generated. However, it is, within the scope of this invention to use initiators even if the binder precursor is exposed to an electron beam. If the energy source is heat, ultraviolet light, or visible light, an initiator may have to be present in order to generate free-radicals. Examples of initiators (that is, photoinitiators) that generate free-radicals upon exposure to ultraviolet light or heat include, but are not limited to, organic peroxides, azo compounds, quinones, nitroso compounds, acyl halides, hydrazones, mercapto compounds, pyrylium compounds, imidazoles, chlorotriazines, benzoin, benzoin alkyl ethers, diketones, phenones, and mixtures thereof. An example of a commercially available photoinitiator that generates free radicals upon exposure to ultraviolet light include those having the trade designation "IRGACURE 651" and "IRGACURE 184", commercially available from Ciba Geigy Company, Hawthorne, N.J., and "DAROCUR 1173", commercially available from Merck & Company, Incorporated, Rahway, N.J. Examples of initiators that generate free-radicals upon exposure to visible light may be found in U.S. Pat. No. 4,735,632. Another photoinitiator that generates free-radicals upon exposure to visible light has the trade designation "IRGACURE 369", commercially available from Ciba Geigy Company.

Typically, the initiator is used in amounts ranging from 0.1 to 10%, preferably 2 to 4% by weight, based on the weight of the binder precursor. Additionally, it is preferred to disperse, preferably uniformly disperse, the initiator in the binder precursor prior to the addition of any particulate material, such as the abrasive particles and/or filler particles.

In general, it is preferred that the binder precursor be exposed to radiation energy, preferably ultraviolet light or visible light. In some instances, certain abrasive particles and/or certain additives will absorb ultraviolet and visible light, which makes it difficult to properly cure the binder precursor. This phenomena is especially true with ceria abrasive particles and silicon carbide abrasive particles. It has been found, quite unexpectedly, that the use of phosphate containing photoinitiators, in particular acylphosphine oxide containing photoinitiators, tend to overcome this problem. An example of such a photoinitiator is 2,4,6-trimethylbenzoyldiphenylphosphine oxide, commercially available from RASF Corporation, Charlotte, N.C., under the trade designation "LUCIRIN TPO". Other examples of commercially available acylphosphine oxides include those having the trade designation "DAROCUR 4263" and "DAROCUR 4265", both commercially available from Ciba Specialty Chemicals.

Optionally, the curable compositions may contain photosensitizers or photoinitiator systems which affect polymerization either in air or in an inert atmosphere, such as nitrogen. These photosensitizers or photoinitiator systems include compounds having carbonyl groups or tertiary amino groups and mixtures thereof. Among the preferred compounds having carbonyl groups are benzophenone, acetophenone, benzil, benzaldehyde, o-chlorobenzaldehyde, xanthone, thioxanthone, 9,10-anthraquinone, and other aromatic ketones which may act as photosensitizers. Among the preferred tertiary amines are methyldiethanolamine, ethyldiethanolamine, triethanolamine, phenylmethylethanolamine, and dimethylaminoethylbenzoate. In general, the amount of photosensitizer or photoinitiator system may vary from about 0.01 to 10% by weight, more preferably from 0.25 to 4.0% by weight, based on the weight of the binder precursor. Examples of photosdnsitizers include those having the trade designation "QUANTICURE ITX", "QUANTICURE QTX", "QUANTICURE PTX", "QUANTICURE EPD", all commercially available from Biddle Sawyer Corp., New York, N.Y.

When high thermally resistant epoxy resin is used, preferred curing agents are aromatic amines and anhydrides. Commercially available aromatic amine curing agents include "ETHACURE 100" and "ETHACURE 300" from Albemarle.

Method for Making Abrasive Articles

The first step to make the abrasive article is to prepare the abrasive slurry that will result in the final abrasive article. The abrasive slurry is made by combining together by any suitable mixing technique the binder precursor, the abrasive particles or agglomerates, and the optional additives. Examples of mixing techniques include low shear and high shear mixing, with high shear mixing being preferred. Ultrasonic energy may also be utilized in combination with the mixing step to lower the abrasive slurry viscosity. Typically, the abrasive particles or agglomerates are gradually added into the binder precursor. It is preferred that the abrasive slurry be a homogeneous mixture of binder precursor, abrasive particles or agglomerates, and optional additives. If necessary, solvent may be added to lower the viscosity. The amount of air bubbles in the abrasive slurry may be minimized by pulling a vacuum either during or after the mixing step. In some instances it is preferred to heat, generally in the range from about 30° C. to about 100° C., the abrasive slurry to lower the viscosity.

The abrasive article may be converted into any desired shape or form depending upon the desired configuration for glass grinding. This converting may be accomplished by slitting, die cutting, or any suitable means.

It is preferable that the abrasive article of the present invention have an integrally molded backing, that is, the abrasive composites are directly bonded to a resin backing which is cast or molded onto the composites while the composites are still in the cavities of the mold. Preferably, the backing is molded before the organic resin of the abrasive composites has completely cured, to allow a better adhesion between the composites and the backing. It may be desirable to include a primer or adhesion promoter to the surface of the composites before the backing is cast to ensure proper adhesion of the backing.

In one embodiment, the backing is about 1 mm to 2 cm thick, more preferably about 0.25 cm to 1 cm thick. The resulting abrasive article should be resilient and compliant to allow it to conform to any back-up pad which may have a curvature or radius associated therewith. In some cases it may be desired to mold the backing with a pre-formed curvature.

The backing may be cast or molded from the same resin as the composites, or may be cast from a different material. Examples of particularly useful backing resins include urethanes, polyureas, epoxies, acrylates, and acrylated urethanes. It is preferable that the backing does not include abrasive particles therein, since these particles would generally not be used for any grinding purposes. However, fillers, fibers, or other additives may be incorporated into the backing. Fibers may be incorporated into the backing to increase the adhesion between the backing and the abrasive composites. Examples of fibers useful in the backings of the invention include those made from silicates, metals, glass, carbon, ceramic, and organic materials. Preferred fibers for use in the backing are calcium silicate fiber, steel fiber, glass fiber, carbon fiber, ceramic fiber, and high modulus organic fibers.

In certain applications it may be desirable to have a more durable and tear-resistant backing which can be accomplished by the inclusion of a scrim material or the like within the molded backing. During molding of the backing, it is possible to lay a scrim or other material over the cavities already filled with resin (but not cured) and then apply another layer of resin over the scrim; or, it is possible to lay a scrim or other material over the uncured molded backing. Preferably, any scrim or additive backing material is sufficiently porous to allow the backing resin to penetrate through and engulf the material.

Useful scrim materials generally are lightweight, open-weave coarse fabrics. Suitable materials include metal or wire meshes, fabrics such as cotton, polyester, rayon, glass cloth, or other reinforcing materials such as fibers. The scrim or reinforcing material may be pretreated to increase the adhesion of the resin to the scrim.

Equipment and Process for Grinding CRT Screens

One particular preferred polisher is a custom built rotary polisher commonly used in commercial manufacturing operations of CRT screens. This same polisher is used for the CPP Test Procedure. The polisher has an adjustable holder than can hold CRT screens with diagonals from 35 to 53 cm (14 to 21 inches). Four corners of the holder need to be adjusted properly so that the center of the screen can match with the center axis of the machine. The holder sits on a flat plate that can rotate in clockwise or counter clockwise direction up to a speed of 1000 rpm. When a CRT screen is placed in the holder, the surface to be polished points upwards.

An abrasive article to be tested is mounted on a fixture called a lap head or a dome. The curvature of the dome is chosen to match closely with the curvature of the surface to be grounded. For flat CRT screens, a flat dome is used. In addition to flat dome, the machine is equipped with domes with curvature of 700 mm to 1800 mm. This allows for grinding screens of various sizes and curvatures.

The abrasive article to be tested can be as large as about 48 cm (19 inches) in diameter and the diameter of the backing material can be up to about 56 cm (22 inches). The article has a central area of approximately about 7.6 cm (3 inches) in which no abrasive composites are present. The center also has a 3.2 cm (1.25 inch) hole to allow for a hollow bolt to be inserted that will attach the abrasive article to the dome and to allow for the coolant to be pumped to the center of the abrasive article during the polishing application.

Typically, the abrasive article is bonded to a support pad made from polyurethane foam, rubber material, an elastomer, a rubber based foam or any other suitable conformable material. The hardness and/or compressibility of the support pad material is selected to provide the desired grinding characteristics (cut rate, abrasive article product life, and glass workpiece surface finish).

The support pad can have a continuous and relatively flat surface or can have a discontinuous surface of a series of raised and lowered portions to which the abrasive article is secured. In the case of a discontinuous surface, the abrasive article may be secured to only the raised portions. The discontinuous surface in the support pad is selected to provide the desired fluid flow of the water and the desired grinding characteristics (cut rate, abrasive article product life, and glass workpiece surface finish). The support pad may have any shape such as circular, rectangular, square, oval, and the like.

The abrasive article may be secured to the support pad by a pressure sensitive adhesive, hook and loop attachment, a mechanical attachment (which can include a ring mounting system along the circumference of the pad), magnetic attachment, or a permanent adhesive. The attachment should securely attach the abrasive article to the support pad and survive the rigors of glass grinding (wet environment, heat generation, and pressures).

If a hook and loop type attachment system is used to secure the abrasive article to the support pad, the loop fabric may be on the back side of the abrasive with hooks on the back-up pad or the system may be reversed with the hooks may be on the back side of the abrasive with the loops on the back-up pad. Hook and loop type attachment systems are further described in U.S. Pat. Nos. 4,609,581; 5,254,194; and 5,505,747, and PCT WO 95/19242.

The force, which provides the contact between the glass surface and the abrasive article, generally is provided by either a hydraulic or pneumatic system. In some embodiments, a hydraulic system is preferred over a pneumatic system, because the hydraulic system can attain the final pressure in a shorter time period than a pneumatic system; this decreases the grinding time needed to achieve the final glass surface. In some embodiments, a pneumatic system is preferred over hydraulic systems, because the pneumatic system has more "play" or "forgiveness" in the system. The air in the pneumatic system is easier to compress than the fluid in a hydraulic system; the compression may provide a cushion that provides a softer contact between the glass surface and the abrasive article.

It is preferred to grind the glass in the presence of a liquid, commonly referred to as a coolant. The liquid inhibits heat build up during grinding and removes the swarf away from the grinding interface. "Swarf" is the term used to describe the actual glass debris that is abraded away by the abrasive article. In some instances, the glass swarf may damage the surface of the glass being ground. Thus, it is desirable to remove the swarf from the interface.

In some instances it is preferred to grind the glass in the presence of a liquid referred to as a "lubricant". Suitable lubricants include water-based solutions of one or more of the following: amines, mineral oil, kerosene, mineral spirits, pine oil, water-soluble emulsions of oils, polyethylenimine, ethylene glycol, propylene glycol, monoethanolamine, diethanolamine, triethanolamine, amine borate, boric acid, amine carboxylate, indoles, thioamine salt, amides, hexahydro-1,3,5-triethyltriazine, carboxylic acids, sodium 2-mercaptobenzothiazole, isopropanolamine, triethylenediamine tetraacetic acid, propylene glycol methyl ether, benzotriazole, sodium 2-pyridinethiol-1-oxide, and hexylene glycol. Lubricants may also include corrosion inhibitors, fungi inhibitors, stabilizers, surfactants, and/or emulsifiers.

Examples of commercially available lubricants that can be used with the abrasive articles of the invention when grinding glass surfaces include: "BUFF-O-MINT", commercially available from Ameratron Products; "CHALLENGE 300HT" and "605 HT", commercially available from Intersurface Dynamics; "CIMTECH GL2015", "CIMTECH CX-417" and "CIMTECH 100", commercially available from Cincinnatic Milacron; "DIAMOND KOOL" and "HEAVY DUTY", commercially available from Rhodes; "K-40", commercially available from LOH Optical; "QUAKER 101", commercially available from Quaker State; "SYNTILO 9930" and "SAFETY-COOL 130", commercially available from Castrol Industrial; "TRIM HM" and "TRIM VHP E320", commercially available from Master Chemical; "LONG LIFE 20/20" commercially available from NCH Corp.; "BLASECUT 883" commercially available from Blase Swisslube; "ICF-31NF", commercially available from Du Bois; "SPECTRA-COOL", commercially available from Salem; "CHEMCOOL 9016" from Brent America; "SURCOOL K-11" commercially available from Texan Ntal; "AFT-G", commercially available from Noritake; and "RUSTLICK", commercially available from Devoon.

The use of a lubricant during glass grinding can increase the cut rate, provide a finer finish, decrease the amount of wear on the abrasive article or extend the useful life of the abrasive article compared to when using water. In one embodiment, the use of a lubricant increases the G-ratio of the article. "G-ratio" is defined as the amount (mass) of workpiece removed in relation to the amount (mass) of abrasive article lost during the process.

As stated, the glass or the abrasive article or both will move during the grinding step. This movement may be rotary, random, linear, or various combinations. Rotary motion may be generated by attaching an abrasive disc to a rotary tool. A random orbital motion may be generated by a random orbital tool, and linear motion may be generated by a continuous abrasive belt. The glass surface and abrasive article may rotate in the same direction or opposite directions. Operating rpm may range up to about 4,000 rpm, depending on the abrasive article employed. The relative movement between glass and abrasive article may also depend on the dimensions of the glass. If the glass is relatively large, it may be preferred to move the abrasive article during grinding while the glass is held stationary.

The abrasive articles described herein, when used for grinding glass surfaces such as CRT screens, remove large quantities of material yet provide smooth surfaces in relatively short periods of time. During grinding, the abrasive article is forced against the glass surface preferably at a pressure of about 0.1 $kg/cm^2$ to about 2 $kg/cm^2$, more preferably from about 0.25 to 1.25 $kg/cm^2$, and even more preferably about 0.4 to 0.85 $kg/cm^2$. If the force is too high, the abrasive article may not refine the scratch depth but rather increase the scratch depth. Also, the abrasive article may wear excessively. If the force is too low, the abrasive article may not effectively remove sufficient glass material.

EXAMPLES

The following non-limiting Examples will further illustrate the invention. All parts, percentages, ratios, and the like are by weight unless otherwise indicated. The following material abbreviations are used throughout the examples.

| | |
|---|---|
| ADI | polytetramethyl glycol/toluene diisocyanate prepolymer, commercially available from Uniroyal Chemical Co., Charlotte, NC, under the trade designation "ADIPRENE L-100"; |
| AER | amorphous fumed silica filler, commercially available from Cabot Corporation, Tuscola, IL, under the trade designation "CAB-O-SIL M5"; |
| AMI | aromatic amine (dimethyl thio toluene diamine), commercially available from Albemarle Corporation, Baton Rouge, LA, under the trade designation "ETHACURE 300"; |
| APS | anionic polyester surfactant, commercially available from ICI Americas, Inc., Wilmington, DE, under the trade designation "FP4"and "PS4"; |
| A-1100 | silane gamma-aminopropyl triethoxysilane, commercially available from OSi Specialties, Danbury, CT; |
| BD | polyvinyl butyral resin, used as a temporary binder for diamond particles, commercially available from Monsanto, Springfield, MA, under the trade designation "BUTVAR DISPERSION"; |
| CaCO3 | calcium carbonate filler, commercially available from ECC International, under the trade designation "Microwhite"; |
| CERIA | cerium oxide, commercially available from Rhone-Poulenc, Shelton, CT, under the trade designation "POLISHING OPALINE"; |
| CMSK | treated calcium metasilicate filler, commercially available from NYCO, Willsboro, NY, under the trade designation "WOLLASTOCOAT 400"; |
| DEX | dextrin, used as temporary binder for diamond particles, commercially available from A.E. Staley Manufacturing Company, Decatur, IL, under the trade designation "Stadex 230"; |
| DIA | industrial diamond particles, commercially available from General Electric, Worthington, OH, under the trade designation "RVG", "Type W"; |
| DIA2 | industrial diamond particles (various sizes), commercially available from Beta Products, Inc., Anaheim Hills, CA, under the trade designation "Metal Bond"; |
| EPO | epoxy resin, commercially available from Shell Chemical Co., Houston, TX, under the trade designation "EPON 828"; |
| ETH | aromatic amine (diethyl toluene diamine), commercially available from Albemarle Corporation, Baton Rouge, LA, under the trade designation "ETHACURE 100"; |
| GLP | glass powder having a particle size of about 325 mesh, commercially available from Specialty Glass, Inc., Oldsmar, FL, under product number "SP 1086"; |
| Graphite | graphite powder, commercially available from Southwestern Graphite Company, a division of Dixon Ticonderoga Company, Bumet, TX, under the trade designation "Grade No. 200-09 Graphite Powder"; |
| KBF4 | potassium fluoroborate, commercially available from Atotech USA, Inc., Rock Hill, SC, then pulverized to less than 78 micron; |
| K-SS | anhydrous potassium silicate, commercially available from PQ Corporation, Valley Forge, PA, under the trade designation "KASOLV SS"; |

-continued

| | |
|---|---|
| K-16 | hydrous potassium silicate, commercially available from PQ Corporation, Valley Forge, PA, under the trade designation "KASOLV 16"; |
| Moly | molybdenum disulfide, commercially available from Aldrich Chemical Company, Milwaukee, WI; |
| RIO | red iron oxide pigment particles; |
| RNH DIA | industrial diamond particles (in various sizes), commercially available from American Boarts Crushing Company Inc., Boca Raton, FL, Type RB and further classified to the desired particle size and measured using a Coulter Multisizer; |
| SIL | surfactant, commercially available from OSi Specialties, Inc., under the trade designation "SILWET L-7604"; |
| SR339 | 2-phenoxyethyl acrylate, commercially available from Sartomer Company, Exton, PA, under the trade designation "SR339"; |
| TFS | trifluoropropylmethyl siloxane antifoamer, commercially available from Dow Corning Company, Midland, MI, under the trade designation "7"; |
| URE | polytetramethylene glycol/toluene diisocyanate prepolymer, commercially available from Uniroyal Chemical Co., Charlotte, NC, under the trade designation "ADIPRENE L-167"; |
| VAZO | 1,1'-azobis(cyclohexanonecarbonitrile), 98%, commercially available from Aldrich Chemical Company, Inc., Milwaukee, WI; and |
| W-G | calcium silicate fibers, commercially available from NYCO Minerals, Inc., Willsboro, NY, under the trade designation "NY AD G Special". |

Production Tool

A production tool was made by drilling a pattern of tapered holes into a 25.0 mm thick sheet of TEFLON™ brand polytetrafluoroethylene (PTFE). The resulting polymeric production tool had cylindrical posts cavities. The height of each post was about 6,300 micrometers and the diameter was about 7,900 micrometers. There were approximately 2,400 micrometers between the bases of adjacent posts.

Test Procedure I

Examples 1–2

The test procedure utilized a "BUEHLER ECOMET 4" variable speed grinder on which was mounted a "BUEHLER ECOMET 2" power head, both of which are commercially available from Buehler Industries, Ltd. The test was performed using the following conditions: motor speed set at 500 rpm with a constant glass/abrasive article interface pressure of either 25.5 psi (about 180 kPa) or 15 psi (about 106 kPa) over the surface area of the glass test blank.

Three flat circular glass test blanks were provided which had a 2.54 cm (1 inch) diameter and a thickness of approximately 1.0 cm, commercially available under the trade designation "CORNING #9061", commercially available from Corning Incorporated. The glass material was placed into the power head of the grinder. The 30.5 cm (12 inch) aluminum platform of the grinder rotated counter clockwise while the power head, into which the glass test blank was secured, rotated clockwise at 35 rpm.

An abrasive article was die cut to approximately a 20 cm (8 inch) diameter circle and was adhered with a pressure sensitive adhesive directly onto a urethane backing pad which had a Shore A hardness of about 90 durometer. The urethane backing pad was attached to an open cell, soft foam pad having a thickness of about 30 mm cut from a sheet of the soft foam. This pad assembly was placed on the aluminum platform of the grinder. Tap water was sprayed onto the abrasive article at a flow rate of approximately 3 liters/minute to provide lubrication between the surface of the abrasive article and the glass test blank.

The glass test blank was ground using the grinder described above. The polishing time interval of the grinder was set at 10 seconds. However, real time contact between the abrasive article and the glass test blank surface was found to be greater than the set time because the grinder did not begin timing until the abrasive article was stabilized on the glass test blank surface. That is, some bouncing or skipping of the abrasive article on the glass surface was observed and the grinder began timing at the point in time when contact between the abrasive article and the glass surface was substantially constant. Thus, real time grinding interval, that is, the contact time between the abrasive article and the glass surface was about 12 seconds when the grinding time interval was set at 10 seconds.

After the 10 second grinding, the surface finish and thickness of the glass were recorded. The glass was then ground for 3 minutes, after which the thickness was again measured. This thickness was the starting point for the next 10 second grinding test.

Example 1

For Example 1, the TEFLON™ brand PTFE mold was filled with the abrasive slurry made according to the formulation in Table 1. Part A and Part B were prepared, heated to 80° C., and then dispensed through a mixing tip into the cavities of the mold.

The filled post cavities were then covered to a depth of approximately 6.4 mm with the backing formulation shown in Table 2 by dispensing Part A and Part B through another mixing tip. Walls surrounding the mold maintain the desired thickness for the backing. An aluminum cover plate was placed over the top of the backing resin during the cure cycle to assure constant, uniform thickness. The entire abrasive article was then cured at 165° C. for 15 hours.

After cure, the sample was removed from the mold and cut to produce a 20 cm diameter circle for testing. Grinding tests were run as described above and the results are reported in Table 3. Table 3 reports 17 grinding measurements recorded at two interface pressures, 25.5 psi (175.8 kPa) and 15 psi (105.5 kPa), in the course of 72 minutes. Each reported measurement is the amount of glass material removed in approximately a 12 second grinding period (machine set to 10 seconds but approximately 12 seconds actual grind time, as described earlier).

Ra and Rz were measured at the end of each data point. The average of the surface finish after all 12 second measurements was Ra=1.2 micrometers, Rz=8.0 micrometers.

TABLE 1

| Abrasive Slurry Formulation | | |
|---|---|---|
| Part A Component | Actual Weight (g) | Weight Percent |
| EPO | 978.33 | 46.90 |
| URE | 52.15 | 2.50 |
| CMSK | 1032.57 | 49.50 |
| AER | 10.43 | 0.50 |
| APS | 10.43 | 0.50 |
| TFS | 2.09 | 0.10 |
| Part B Component | Actual Batch Weight (g) | Weight Percent |
| ETH | 258.58 | 18.47 |
| RIO | 1.40 | 0.10 |
| CaCO3 | 798.00 | 57.00 |
| DIA Grade 200/230 | 301.32 | 21.52 |
| AER | 28.00 | 2.00 |
| APS | 11.34 | 0.81 |
| TFS | 1.40 | 0.10 |

TABLE 2

| Backing Formulation | | |
|---|---|---|
| | Actual Weight (g) | Weight Percent |
| Part A Component | | |
| ADI | 8020.00 | 100.00 |
| Part B Component | | |
| AMI | 843.00 | 84.30 |
| CMSK | 95.00 | 9.50 |
| RIO | 35.00 | 3.50 |
| AER | 17.00 | 1.70 |
| TFS | 10.00 | 1.00 |

TABLE 3

| Grinding Data | | |
|---|---|---|
| Time (minutes) | Interface Pressure (psi) | Stock Removed (μm) |
| 0.17 | 25.5 | 185 |
| 0.33 | 25.5 | 562 |
| 2.5 | 25.5 | 552 |
| 5.17 | 25.5 | 480 |
| 8 | 25.5 | 449 |
| 11.33 | 25.5 | 449 |
| 14.66 | 25.5 | 430 |
| 18 | 25.5 | 437 |
| 21.33 | 25.5 | 418 |
| 24.67 | 25.5 | 444 |
| 28.17 | 25.5 | 432 |
| 31.5 | 25.5 | 425 |
| 37.67 | 15 | 211 |
| 45.83 | 15 | 197 |
| 54.5 | 15 | 192 |
| 63.67 | 15 | 209 |
| 72 | 15 | 168 |

Example 2

Example 2 was prepared as described in Example 1 except that the abrasive slurry formulation is given in Table 4 and the backing formulation is given in Table 5. Example 2 was tested as described above and the results are reported in Table 6. Table 6 reports 14 grinding measurements recorded at two interface pressures, 25.5 psi (175.8 Pa) and 15 psi (105.5 kPa), in the course of 117 minutes. Each reported measurement is the amount of glass material removed in approximately a 12 second grinding period (machine set to 10 seconds but approximately 12 seconds actual grind time, as described earlier).

Ra and Rz were measured at the end of each data point. The average of the surface finish after all 12 second measurements was Ra=0.8 micrometers, Rz=5.8 micrometers.

TABLE 4

| Abrasive Slurry Formulation | | |
|---|---|---|
| | Actual Batch Weight (g) | Weight Percentage |
| Part A Component | | |
| EPO | 978.33 | 46.90 |
| URE | 52.15 | 2.50 |
| CMSK | 1032.57 | 49.50 |
| CaCO3 | 0.00 | 0.00 |
| AER | 10.43 | 0.50 |
| APS | 10.43 | 0.50 |
| TFS | 2.09 | 0.10 |
| Part B Component | | |
| ETH | 258.58 | 18.47 |
| RIO | 1.40 | 0.10 |
| CaCO3 | 798.00 | 57.00 |
| DIA Grade 270/325 | 301.32 | 21.52 |
| AER | 28.00 | 2.00 |
| APS | 11.34 | 0.81 |
| TFS | 1.40 | 0.10 |

TABLE 5

| Backing Formulation | | |
|---|---|---|
| | Actual Batch Weight (g) | Weight Percentage |
| Part A Component | | |
| ADI | 8020.00 | 100.00 |
| Part B Component | | |
| AMI | 843.00 | 84.30 |
| CMSK | 95.00 | 9.50 |
| RIO | 35.00 | 3.50 |
| AER | 17.00 | 1.70 |
| TFS | 10.00 | 1.00 |

TABLE 6

| Grinding Data | | |
|---|---|---|
| Time (minutes) | Interface Pressure (psi)(kPa) | Stock Removed (μm) |
| 0.67 | 25.5 (175.8) | 430 |
| 4.33 | 25.5 (175.8) | 348 |
| 9 | 25.5 (175.8) | 317 |
| 14.16 | 25.5 (175.8) | 283 |
| 19.83 | 25.5 (175.8) | 252 |
| 25 | 25.5 (175.8) | 244 |
| 31 | 25.5 (175.8) | 250 |
| 36.5 | 25.5 (175.8) | 235 |
| 44.17 | 25.5 (175.8) | 214 |
| 51.83 | 25.5 (175.8) | 214 |
| 64 | 15 (105.5) | 103 |
| 79.67 | 15 (105.5) | 86 |

TABLE 6-continued

| Grinding Data | | |
|---|---|---|
| Time (minutes) | Interface Pressure (psi)(kPa) | Stock Removed (μm) |
| 98.83 | 15 (105.5) | 72 |
| 117 | 15 (105.5) | 91 |

A. The Preparation Procedure of the Diamond Agglomerate Samples

The ingredients of each diamond agglomerate sample are listed in Table 7 below.

TABLE 7

| Diamond Agglomerate Samples 1–4 | | | | |
|---|---|---|---|---|
| Component | Agglomerate Batch 1 (g) | Agglomerate Batch 2 (g) | Agglomerate Batch 3 (g) | Agglomerate Batch 4 (g) |
| BD | 30.00 | 30.00 | 30.00 | 30.00 |
| Water | 8.60 | 8.60 | 8.60 | 8.60 |
| GP | 20.99 | 20.00 | 20.00 | 20.00 |
| RNH DIA | 20.00 (20 μm) | 20.00 (30 μm) | 20.00 (15 μm) | 20.00 (40 μm) |
| Agglomerate Size | 225 μm | 225 μm | 225 μm | 355 μm |

All the ingredients of each agglomerate sample were combined and mixed in a plastic beaker by hand with a spatula to form a diamond dispersion. The diamond dispersion was then coated into a 9 mil random pattern plastic tool having gumdrop-shaped cavities, or a 14 mil flat top truncated pyramid plastic tool with a flexible plastic spatula to form the agglomerates. The method of making the plastic tool is described in U.S. Pat. No. 5,152,917 (Pieper et al). The molded agglomerate samples were dried in the mold at room temperature overnight. The molded agglomerate samples were removed from the mold using an ultrasonic horn. The agglomerate samples were then screened using a 70 mesh screen (for 9 mil) or a 40 mesh screen (for 14 mil) to separate them from each other. After separation, the size of the agglomerates ranged from about 175 to about 250 micrometers (for 9 mil) and about 350 to 400 micrometers (for 14 mil).

The screened agglomerate samples were placed in an alumina sagger and fired in air through the following cycle:

Room temperature to 400° C. at 2.0° C./minute;

Hold at 400° C. for 1 hour;

400° C. to 720° C. at 2.0° C./minute;

Hold at 720° C. for 1 hour; and

720° C. to room temperature at 2.0° C./minute.

The agglomerates were then screened using a 70 mesh screen as described above.

The fired agglomerate samples were then treated with a silane solution so to provide the agglomerates with better adhesion to the epoxy resin system. The silane solution was made by mixing 1.0 g A-1100 Silane and 99.0 g Water.

The agglomerate samples were wetted with the silane solution and the excess was poured off. The silane solution-treated agglomerate samples were then placed in a 90° C. oven and dried for 30 minutes. The dried agglomerate samples were screened as described above using a 70 mesh screen.

B. Preparation Procedure of Examples 3–6 and Comparative Examples A–D

For Examples 3–6 and Comparative Examples A–D, the PTFE mold of Example 1 was filled with the abrasive slurry made according to the formulations Table 8. Part A and Part B were mixed separately in plastic beakers with a high shear mixer, placed separately in a vacuum oven to remove air bubbles, then filled together in to a 2:1 volume ratio mixing cartridges, 2 parts A to 1 part B. Then the resultant abrasive slurry was dispensed through an automatic mixing tip into the cavities of the mold.

The filled post cavities were then covered to a depth of approximately 6.4 mm (¼ inch) with the backing formulations of Table 9. The components of Part B were mixed in a plastic beaker with a high shear mixer, removing air bubbles by placing the samples in a vacuum oven, and then by mixing Part A with Part B with a low shear mixer, so to minimize bubble entrapment. Walls surrounding the mold maintained the desired thickness for the backing. An aluminum cover plate was placed over the top of the backing resin during the cure cycle to assure constant, uniform thickness. The mold was clamped closed and allowed to cure at room temperature for one to two hours and then in an oven for 4 hours at 165° C. The mold was removed from the oven and opened. The molded abrasive samples were taken from mold and mounted on a 30.48 cm (12 inches) platen for a Buehler lap.

The molded abrasive samples had a 30.48 cm (12 inches) diameter backing and abrasive posts of 1.59 cm (⅝ inch) in diameter. The abrasive posts were bonded to the backing so that the circular area that covers the center (15.24 cm (6 inches)) had no abrasive posts.

| Component | Comp. Ex. A (g) | Comp. Ex. B (g) | Comp. Ex. C (g) | Comp. Ex. D (g) | Example 3 (g) | Example 4 (g) | Example 5 (g) | Example 6 (g) |
|---|---|---|---|---|---|---|---|---|
| Part A | | | | | | | | |
| EPO | 70.35 | 70.35 | 71.76 | 73.87 | 74.57 | 74.57 | 74.57 | 74.57 |
| URE | 3.75 | 3.75 | 3.83 | 3.94 | 3.98 | 3.98 | 3.98 | 3.98 |
| CMSK | 74.25 | 74.25 | 75.74 | 77.96 | 78.71 | 78.71 | 78.71 | 78.71 |
| AER | 0.75 | 0.75 | 0.77 | 0.79 | 0.80 | 0.80 | 0.80 | 0.80 |
| APS | 0.75 | 0.75 | 0.77 | 0.79 | 0.80 | 0.80 | 0.80 | 0.80 |
| TFS | 0.15 | 0.15 | 0.15 | 0.79 | 0.16 | 0.16 | 0.16 | 0.16 |
| Part B | | | | | | | | |
| ETH | 18.47 | 18.47 | 17.80 | 18.49 | 18.49 | 18.49 | 18.49 | 18.49 |
| RIO | 0.10 | 0.10 | 0.10 | 0.10 | 0.10 | 0.10 | 0.10 | 0.10 |
| CMSK | 27.77 | 27.77 | 27.89 | 28.00 | 28.00 | 28.00 | 28.00 | 28.00 |

-continued

| Component | Comp. Ex. A (g) | Comp. Ex. B (g) | Comp. Ex. C (g) | Comp. Ex. D (g) | Example 3 (g) | Example 4 (g) | Example 5 (g) | Example 6 (g) |
|---|---|---|---|---|---|---|---|---|
| CaCO3 | 34.50 | 34.50 | 43.00 | 43.00 | 43.00 | 43.00 | 43.00 | 43.00 |
| DIA | 7.15 | 7.15 | 3.65 | 7350 | 3.75 | 3.75 | 3.75 | 3.75 |
| Nickel on DIA | 9.10 | 9.10 | 4.65 | — | — | — | — | — |
| Glass on DIA | — | — | — | — | 3.75 | 3.75 | 3.75 | 3.75 |
| AER | 2.00 | 2.00 | 2.00 | 2.00 | 2.00 | 2.00 | 2.00 | 2.00 |
| APS | 0.81 | 0.81 | 0.81 | 0.81 | 0.81 | 0.81 | 0.81 | 0.81 |
| TFS | 0.10 | 0.10 | 0.10 | 0.10 | 0.10 | 0.10 | 0.10 | 0.10 |
| Diamond Type | DIA | DIA | DIA | RNH DIA | Agglomerate Batch 1 | Agglomerate Batch 2 | Agglomerate Batch 3 | Agglomerate Batch 4 |
| Diamond Size | 65 um (Grade 230/270) | 45 um (Grade 325/400) | 65 um (Grade 230/270) | 40 um | 20 um | 30 um | 15 um | 40 um |
| Volume % Diamond | 1.5 | 1.5 | 0.75 | 1.5 | 0.74 | 0.74 | 0.74 | 0.74 |

TABLE 9

Backing Formulations

| Component | Comp. Example A (g) | Comp. Example B (g) | Comp. Example C (g) | Comp. Example D (g) | Example 3 (g) | Example 4 (g) | Example 5 (g) | Example 6 (g) |
|---|---|---|---|---|---|---|---|---|
| Part A | | | | | | | | |
| ADI | 783.64 | 783.64 | 783.64 | 783.64 | 783.64 | 783.64 | 783.64 | 783.64 |
| Part B | | | | | | | | |
| AMI | 80.85 | 80.85 | 80.85 | 80.85 | 80.85 | 80.85 | 80.85 | 80.85 |
| CMSK | 12.95 | 12.95 | 12.95 | 12.95 | 12.95 | 12.95 | 12.95 | 12.95 |
| RIO | 3.50 | 3.50 | 3.50 | 3.50 | 3.50 | 3.50 | 3.50 | 3.50 |
| AER | 1.70 | 1.70 | 1.70 | 1.70 | 1.70 | 1.70 | 1.70 | 1.70 |
| TFS | 1.00 | 1.00 | 1.00 | 1.00 | 1.00 | 1.00 | 1.00 | 1.00 |
| Total = | 100.00 | 100.00 | 100.00 | 100.00 | 100.00 | 100.00 | 100.00 | 100.00 |

Test Procedure II

Examples 3–6

Test Procedure II was the same as Test Procedure I, except for the following:

The abrasive article was die cut to approximately a 30.45 cm (12 inch) diameter circle and was adhered with a pressure sensitive adhesive directly onto a 12.5 mm thick neoprene backing pad which had a Shore A hardness of about 60 durometer. This pad assembly was placed on the aluminum platform of the grinder.

An initial surface finish on the glass test blank was evaluated with a diamond stylus profilometer, commercially available under the trade designation "PERTHOMETER", commercially available from Mahr Corp. An initial weight of the glass test blank was also recorded.

The glass test blank was ground from 12 seconds to several minutes. All data was normalized and reported as average glass stock removed in 12 seconds of polishing.

After grinding, final surface finish and a final weight were recorded. The change in weight of the glass test blank over the grinding time is shown as grams of glass stock removed. The cut rate (glass stock in grams removed), Ra, and Rmax values were recorded.

The grinding test results of Example 3, listed in Table 10, show that abrasive articles containing diamond agglomerates provide consistent stock removal rates at various pressures.

The grinding test results of Example 6 and Comparative Example D, listed in Table 11, show that stock removal rates for abrasive articles containing diamond agglomerates is significantly higher than stock removal rates for abrasive articles with individual diamond particles of the same size.

The grinding test results of Comparative Example C and Example 4, listed in Table 12, show that the stock removal rates of abrasive articles with diamond agglomerates is significantly higher than that of abrasive articles with individual diamond particles of larger size.

TABLE 10

Grinding Data and Conditions of Example 3

| Time (minutes) | Stock Removal (micrometers/12 sec) | Pressure (kPa) |
|---|---|---|
| 1 | 76 | 106 |
| 4 | 78 | 106 |
| 7 | 81 | 106 |
| 16 | 81 | 106 |
| 26 | 79 | 106 |
| 31 | 78 | 106 |
| 46 | 77 | 106 |
| 61 | 76 | 106 |
| 91 | 78 | 106 |
| 121 | 81 | 106 |
| 136 | 62 | 53 |
| 151 | 64 | 53 |
| 181 | 66 | 53 |

TABLE 10-continued

| Grinding Data and Conditions of Example 3 | | |
|---|---|---|
| Time (minutes) | Stock Removal (micrometers/12 sec) | Pressure (kPa) |
| 201 | 67 | 53 |
| 251 | 63 | 53 |
| 367 | 14 | 26.5 |
| 372 | 10 | 26.5 |
| 377 | 9 | 26.5 |
| 382 | 11 | 26.5 |
| 397 | 9 | 26.5 |
| 412 | 10 | 26.5 |

TABLE 11

| Stock Removal Rates for Comparative Example D and Example 6 | | |
|---|---|---|
| Time (minute) | Comparative Example D | Example 6 |
| 24 | 33 | / |
| 34 | 32 | / |
| 44 | 28 | / |
| 54 | 22.5 | / |
| 64 | 18.5 | / |
| 65 | / | 119 |
| 74 | 17.8 | / |
| 75 | / | 111 |
| 78 | / | 101 |
| 84 | 15.2 | / |
| 88 | / | 100 |
| 104 | 12.8 | / |
| 107 | / | 110 |
| 112 | / | 107 |
| 124 | 10.5 | / |
| 126 | / | 105 |
| 144 | 9.5 | / |

TABLE 12

| Grinding Data of Comparative Example C and Example 4 | | |
|---|---|---|
| | Stock Removal (micrometers removed/12 sec) | |
| Time (Minutes) | Comparative Example C | Example 4 |
| 117 | 52 | / |
| 127 | 45 | / |
| 137 | 41 | / |
| 145 | / | 81 |
| 147 | 39 | / |
| 150 | / | 79 |
| 157 | 36 | / |
| 160 | / | 81 |
| 165 | / | 79 |
| 167 | 34 | / |
| 177 | 33 | / |
| 320 | / | 68 |
| 410 | / | 64 |
| 425 | / | 70 |
| 435 | / | 73 |
| 450 | / | 77 |

The surface smoothness data (Ra and Rmax) of Comparative Example B and Example 5 are listed in Table 13 below. These data show three advantages of this invention. First, the Ra data show that the surface finish provided by Example 5 with diamond agglomerates is finer than that of Comparative Example B with individual diamond particles with similar stock removal rates. Second, the Ra and Rmax data demonstrate that surface finish is improved at higher relative speed for Example 5 with diamond agglomerates whereas it does not improve for Comparative Example B with individual diamond particles. Finally, the Rmax data show that scratch depth is smaller with Example 5 with diamond agglomerates than that of Comparative Example B with individual diamond particles with similar stock removal rates.

TABLE 13

| Surface Smoothness of Comparative Example B and Example 5 | | | | |
|---|---|---|---|---|
| Speed | Comparative Example B Surface Smoothness (μm) | | Example 5 Surface Smoothness (μm) | |
| (RPM) | Ra | Rmax | Ra | Rmax |
| 100 | 0.68 | 5.9 | 0.61 | 5.38 |
| 200 | 0.68 | 5.93 | 0.5 | 4.79 |
| 300 | 0.71 | 6.93 | 0.46 | 4.9 |
| 400 | 0.62 | 5.98 | 0.42 | 4.1 |
| 500 | / | / | 0.38 | 3.9 |

The surface smoothness data (Ra and Rmax) of Comparative Example A and Example 4 are listed in Table 14. These data show three advantages of this invention. First, the Ra data show that the surface finish provided by abrasive articles with diamond agglomerates is finer than that of abrasive articles with individual diamond particles with similar stock removal rates. Second, the Ra and Rmax data demonstrate that surface finish is improved at higher relative speed for abrasive articles with diamond agglomerates whereas it does not improve for abrasive articles with individual diamond particles. Finally, the Rmax data show that scratch depth is smaller with abrasive articles with diamond agglomerates than that of abrasive articles with individual diamond particles with similar stock removal rates.

TABLE 14

| Surface Smoothness of Comparative Example A and Example 4 | | | | |
|---|---|---|---|---|
| Speed | Comparative Example A Surface Smoothness (μm) | | Example 4 Surface Smoothness (μm) | |
| (RPM) | Ra | Rmax | Ra | Rmax |
| 100 | 0.86 | 7.61 | 0.8 | 7.49 |
| 200 | 0.86 | 7.54 | 0.69 | 7.17 |
| 300 | 0.85 | 7.66 | 0.62 | 5.64 |
| 400 | 0.8 | 7.21 | 0.62 | 5.43 |
| 500 | / | / | 0.54 | 5.14 |

Testing Procedure III

Examples 7–11

A small area (about 17.78 cm×17.78 cm) of a CRT screen was first roughened with a 5 micron aluminum oxide disc (268XA Trizact™ film PSA discs, A5MIC, commercially available from 3M, St. Paul, Minn.) using a hand held sander (commercially available from Flex, model LW 603VR, 1,000–2,800 rpm, 1,500 W). The sander was operated at 2,400 rpm and water was supplied through a hole in the middle of the sander. A abrasive article tested was mounted onto the sander. The pre-roughened area of the CRT screen was polished for 30 seconds at 2,400 rpm. The breakdown of the post was determined visually by the amount of loose ceria slurry produced during polishing. The rating of the breakdown test is from 1 to 5, with 1 being "little breakdown" and 5 being "excessive breakdown". The optimum rating is 3 with "moderate breakdown". Excessive breakdown of the abrasive posts provides good polishing performance but shortens the life of the polishing pad. Insufficient breakdown of the abrasive posts gives a long life but provides poor polishing performance.

Adhesion of the posts to the backing is very important. If the post to backing adhesion is low, the posts may detach from the backing during polishing. The results of the adhesion test are determined by measuring the percentage of posts detached from the backing after polishing.

Preparation Procedure of Examples 7–11

A production tool was made by drilling a pattern of tapered holes into a 25.0 mm thick sheet of TEFLON™ brand polytetrafluoroethylene (PTFE). The resulting polymeric production tool contained cavities that were cylindrical posts with a height of about 4 mm and diameter of about 4.8 mm. There were approximately 2.4 mm between the bases of adjacent posts.

Examples 7–11, the mold of was filled with the abrasive slurry made according to the formulations in Table 15. The ingredients were mixed in a plastic beaker with a high shear mixer, placed in a vacuum oven to remove air bubbles, then filled in to a cartridge. The resultant abrasive slurry was dispensed through an automatic mixing tip into the cavities of the mold.

The backings were prepared by first mixing the components of Part B, according to Table 16, in a plastic beaker with a high shear mixer, removing air bubbles by placing the samples in a vacuum oven, and then by mixing Part A with Part B with a low shear mixer, so to minimize bubble entrapment. The filled post cavities were then covered to a depth of approximately 6.4 mm by dispensing the formulation through an auto-mix tip. Walls surrounding the mold maintained the desired thickness for the backing. An aluminum cover plate was placed over the top of the backing resin during the cure cycle to assure constant, uniform thickness. The mold was clamped closed and allowed to cure at room temperature for one to two hours, and then in an oven for 4 hours at 165° C. The mold was removed from the oven and opened.

TABLE 15

Formulations (parts by wt.) of the Abrasive Slurry of Examples 7–11

| Components | Example 7 | Example 8 | Example 9 | Example 10 | Example 11 |
|---|---|---|---|---|---|
| EPO | 9.58 | 9.42 | 9.35 | 9.35 | 9.33 |
| ETH | 2.30 | 2.26 | 2.25 | 2.25 | 2.24 |
| SR339 | 2.10 | 2.08 | 2.06 | 2.06 | 2.06 |
| APS | 1.24 | 1.30 | 1.29 | 1.29 | 1.29 |
| VAZO | 0.05 | 0.05 | 0.05 | 0.05 | 0.05 |
| CERIA | 79.99 | 78.64 | 78.04 | 78.04 | 77.92 |
| K-16 | 0.0 | 6.11 | 6.06 | 6.06 | 3.03 |
| K-SS | 4.66 | 0.00 | 0.00 | 0.00 | 3.03 |
| KBF4 | 0.00 | 0.00 | 0.76 | 0.76 | 0.76 |
| TFS | 0.08 | 0.15 | 0.15 | 0.15 | 0.30 |
| Total | 100.00 | 100.00 | 100.00 | 100.00 | 100.00 |

TABLE 16

Backing Formulations (parts by wt.) for Examples 7–11

| | Example 7 | Example 8 | Example 9 | Example 10 | Example 11 |
|---|---|---|---|---|---|
| Part A Components | | | | | |
| ADI | 50.00 | 50.00 | 50.00 | 81.33 | 81.2 |
| W-G | 0.00 | 0.00 | 0.00 | 6.55 | 6.54 |
| TFS | 0.00 | 0.00 | 0.00 | 0.00 | 0.16 |
| Part B Components | | | | | |
| AMI | 42.15 | 42.15 | 42.15 | 8.39 | 8.37 |
| CMSK | 4.75 | 4.75 | 4.75 | 0.00 | 0.00 |
| RIO | 1.75 | 1.75 | 1.75 | 0.36 | 0.36 |
| AER | 0.85 | 0.85 | 0.85 | 0.00 | 0.00 |
| TFS | 0.50 | 0.50 | 0.50 | 0.09 | 0.09 |
| W-G | 0.00 | 0.00 | 0.00 | 3.28 | 3.27 |

The results of the Adhesion Test are shown in Table 17.

TABLE 17

The Breakdown and Adhesion Test Results Of Examples 7–11

| Test | Example 7 | Example 8 | Example 9 | Example 10 | Example 11 |
|---|---|---|---|---|---|
| Breakdown | 2 | 3 | 4 | 4 | 3 |
| Adhesion (% of post detached) | 0 | 6 | 5 | 0.7 | 0 |

Preparation Procedure of Examples 12–14

For Example 12–14, the PTFE mold of Examples 7–11 was filled with the abrasive slurry made according to the formulations in Table 18. The ingredients were mixed in a plastic beaker with a high shear mixer, placed in a vacuum oven to remove air bubbles, then filled in to a cartridge. Then the resultant abrasive slurry was dispensed through an automatic mixing tip into the cavities of the mold.

The filled post cavities were then covered to a depth of approximately 4.0 mm with the backing formulation in Table 19 by dispensing the formulation through an auto-mix tip. The backing formulation was prepared by mixing the components of Part A and B in a plastic beaker with a high shear mixer, and removing air bubbles by placing the samples in a vacuum oven so to minimize bubble entrapment. Walls surrounding the mold maintained the desired thickness for the backing. An aluminum cover plate was placed over the top of the backing resin during the cure cycle to assure constant, uniform thickness. The mold was clamped closed and allowed to cure at room temperature for one to two hours, and then in an oven for 4 hours at 165° C. The mold was removed from the oven and opened.

The molded abrasive samples had a backing of 20.3 cm (8 inches) in diameter and 4 mm in thickness, and abrasive posts of 4.8 mm (3/16 inch) in diameter and 4.0 mm in height.

TABLE 18

Formulations (parts by wt.) of the Abrasive Posts of Examples 12–14

| Components | Example 12 | Example 13 | Example 14 |
|---|---|---|---|
| EPO | 10.18 | 10.01 | 9.81 |
| ETH | 2.45 | 2.41 | 2.36 |

TABLE 18-continued

| Formulations (parts by wt.) of the Abrasive Posts of Examples 12–14 | | | |
|---|---|---|---|
| Components | Example 12 | Example 13 | Example 14 |
| SR339 | 2.24 | 2.21 | 2.16 |
| APS | 1.40 | 1.38 | 1.35 |
| VAZO | 0.05 | 0.05 | 0.05 |
| CERIA | 75.92 | 74.69 | 73.14 |
| K-16 | 3.30 | 3.25 | 3.18 |
| K-SS | 3.30 | 3.25 | 3.18 |
| KBF4 | 0.83 | 0.81 | 0.80 |
| Graphite | 0 | 1.62 | 0 |
| Moly | 0 | 0 | 3.66 |
| TFS | 0.33 | 0.32 | 0.32 |
| Total | 100.00 | 100.00 | 100.00 |

TABLE 19

| Backing Formulations of Examples 12–14 | |
|---|---|
| | parts by weight |
| Part A Components | |
| ADI | 82.89 |
| W-G | 6.68 |
| TFS | 0.5 |
| APS | 0.16 |
| TiO2 | 0.67 |
| Moly | 0.56 |
| Part B Components | |
| AMI | 8.55 |

Test Procedure IV

Examples 12–14

The test procedure utilized a Buehler ECOMET 3 polisher, commercially available from Buehler Industries, Ltd. Examples 12–14 were conditioned in the Buehler machine at 8.49 psi (58.5 KPa) and 500 rpm platen speed with a sand-blasted 3 inch (7.62 cm) disc from regular window glass to generate a uniform and flat surface finish.

A 2 inch (5.08 cm) CRT glass disc (commercially available from Philips) was pre-roughened with an 8 inch (20.32 cm) A10 grade glass repair disk (commercially available from 3M under the trade name 3M 268XA Trizact), on the Buehler machine for about 30 seconds at about 1.23 psi (8.48 KPa) and 500 rpm. This generated a uniform input finish of Ra about 0.07 micrometers.

Then the pre-roughened CRT glass disc was used to test an example of the Buehler machine at 19.1 psi (131.7 KPa) and 500 rpm platen speed. The water flow was fixed at 660 cc/minute. Measurements of the surface finish were made at every 15-second interval and repeated up to 45 seconds by a diamond stylus profilometer, commercially available under the trade designation Perthometer from Mahr Corp.

The surface finish data of examples 12–14 are summarized in Table 20. The data show that Example 13 and Example 14 with graphite and molybdenum disulfide respectively reduce the surface roughness from 0.070 micrometers to 0.009 micrometers in 15 seconds whereas it takes the control (Example 12 without graphite or molybdenum disulfide) 45 seconds to do so.

TABLE 20

| The Surface Finish data (μm in Ra) of Examples 12–14 | | | |
|---|---|---|---|
| Polishing time, sec | Example 12 | Example 13 | Example 14 |
| 0 | 0.070 | 0.0700 | 0.0683 |
| 15 | 0.018 | 0.0086 | 0.0093 |
| 30 | 0.012 | 0.0085 | 0.0040 |
| 45 | 0.009 | 0.0085 | 0.0056 |

Examples 15–20 and Comparative Examples E–H

For Examples 15–20 and Comparative Examples E–H, the PTFE mold was filled with the abrasive slurry made according to the formulations in Table 21. Part A and Part B were mixed separately in plastic beakers with a high shear mixer, and then mixed together. Part C, which were the agglomerates prepared according to the formulations in Table 23, were added to the A:B mixture. The resulting abrasive slurry was poured into the cavities of the mold.

Each of Comparative Examples E–H were made from the same formulation, which included 2.8% diamond agglomerates, except that different sized diamonds were in the agglomerates. For Comparative Example E, Agglomerate Batch 5 was used; for Comparative Example F, Agglomerate Batch 6 was used; for Comparative Example G, Agglomerate Batch 7 was used; and for Comparative Example H, Agglomerate Batch 8 was used. The Agglomerate Batches were made as per Table 23.

For the backing, Components of Part B were mixed in a plastic beaker with a high shear mixer, and then mixed Part A with Part B with a low shear mixer, so to minimize bubble entrapment. The filled post cavities were covered to a depth of approximately 6.4 mm (¼ inch) with the backing formulation shown in Table 22. Walls surrounding the mold maintained the desired thickness of the backing. An aluminum cover plate was placed over the top of the backing resin during the cure cycle to assure constant, uniform thickness. The mold was clamped closed and allowed to cure at room temperature for one to two hours and then in an oven for 4 hours at 165° C. The mold was removed from the oven and opened. The molded abrasive article was taken from the mold.

The molded abrasive article had a backing of 55.88 cm (22 inches) in diameter and abrasive posts of 1.59 cm (⅝ inch) in diameter. The abrasive posts were bonded to backing such that the circular area that covers the center (7.62 cm (3 inches)) has no abrasive posts. A 1.25 inch (3.18 cm) hole was cut in the center of the disc to allow a hollow bolt to be inserted that will attach the abrasive article to the dome of the Rotary Polisher and to allow coolant to be pumped to the center of the abrasive article during the polishing operation. The abrasive article was then tested using the CPP Test Procedure, described earlier.

TABLE 21

| Formulations (parts by wt.) for Abrasive Slurry | | | | | | | |
|---|---|---|---|---|---|---|---|
| | Comp. Ex. E-H | Ex. 15 | Ex. 16 | Ex. 17 | Ex. 18 | Ex. 19 | Ex. 20 |
| Part A Comp. | | | | | | | |
| EPO | 28.82 | 28.01 | 22.26 | 29.30 | 29.30 | 29.30 | 29.30 |
| URE | 1.54 | 1.49 | 1.19 | 1.58 | 1.58 | 1.58 | 1.58 |
| CMSK | 30.42 | 29.56 | 23.5 | 0 | 0 | 0 | 0 |
| AER | 0.31 | 0.30 | 0.24 | 0.32 | 0.32 | 0.32 | 0.32 |

TABLE 21-continued

| Formulations (parts by wt.) for Abrasive Slurry | | | | | | | |
|---|---|---|---|---|---|---|---|
| | Comp. Ex. E-H | Ex. 15 | Ex. 16 | Ex. 17 | Ex. 18 | Ex. 19 | Ex. 20 |
| APS | 0.31 | 0.30 | 0.24 | 0.32 | 0.32 | 0.32 | 0.32 |
| TFS | 0.06 | 0.06 | 0.05 | 0.06 | 0.06 | 0.06 | 0.06 |
| Part B Comp. | | | | | | | |
| ETH | 7.13 | 6.93 | 5.51 | 7.25 | 7.25 | 7.25 | 7.25 |
| RIO | 0.04 | 0.03 | 0.03 | 0.04 | 0.04 | 0.04 | 0.04 |
| CMSK | 10.79 | 10.48 | 8.33 | 0 | 0 | 0 | 0 |
| CaCO3 | 16.57 | 16.10 | 12.80 | 0 | 0 | 0 | 0 |
| AER | 0.80 | 0.78 | 0.62 | 0.80 | 0.80 | 0.80 | 0.80 |
| APS | 0.28 | 0.27 | 0.22 | 0.29 | 0.29 | 0.29 | 0.29 |
| TFS | 0.04 | 0.03 | 0.03 | 0.04 | 0.04 | 0.04 | 0.04 |
| Part C Comp. | | | | | | | |
| Agglom. Batch 5 | 2.89 (Comp. E) | / | / | 60 30% | / | / | / |
| Agglom. Batch 6 | 2.89 (Comp. F) | 5.65 | 25.00 | / | 60 | / | / |
| Agglom. Batch 7 | 2.89 (Comp. G) | / | / | / | / | 60 | / |
| Agglom. Batch 8 | 2.89 (Comp. H) | / | / | / | / | / | 60 |

TABLE 22

| Backing Formulation | | |
|---|---|---|
| | Actual Weight (g) | Weight Percent |
| Part A Component | | |
| ADI | 8020.00 | 100.00 |
| Part B Component | | |
| AMI | 843.00 | 84.30 |
| CMSK | 95.00 | 9.50 |
| RIO | 35.00 | 3.50 |
| AER | 17.00 | 1.70 |
| TFS | 10.00 | 1.00 |

The Preparation Procedure of the Diamond Agglomerate Batches

All the ingredients of each agglomerate batch, listed in Table 23, were combined and mixed in a plastic beaker by hand with a spatula to form a diamond dispersion.

TABLE 23

| Formulations for Diamond Agglomerate Batches 5–8 | | | | |
|---|---|---|---|---|
| Component | Agglomerate Batch 5 (g) | Agglomerate Batch 6 (g) | Agglomerate Batch 7 (g) | Agglomerate Batch 8 (g) |
| DEX | 33 | 33 | 33 | 33 |
| Water | 50 | 50 | 50 | 50 |
| GP | 50 | 50 | 50 | 50 |
| SIL | 0.7 | 0.7 | 0.7 | 0.7 |
| DIA | 50 (50 μm) | 50 (25 μm) | 50 (20 μm) | 50 (15 μm) |
| Agglomerate Size | 355 μm | 225 μm | 225 μm | 225 μm |

The diamond dispersion was coated into either a 14 mil (355 μm) flat top or 9 mil (225 μm) random pattern plastic tool having either square-wave-shaped or gumdrop-shaped cavities, using a flexible plastic spatula. The method of making the plastic tool is described in U.S. Pat. No. 5,152,917 (Pieper et al.). The molded agglomerates were dried in the mold at room temperature overnight and were removed from the mold using an ultrasonic horn. The agglomerates were screened to separate them from each other. After separation, the size of the agglomerates ranged from about 175 to about 250 micrometers. The screened agglomerates were placed in an alumina sagger and fired in air using the following cycle:

Room temperature to 400° C. at 1.5° C./minute;
Hold at 400° C. for 2 hours;
400° C. to 720° C. at 1.5° C./minute;
Hold at 720° C. for 1 hour; and
720° C. to room temperature at 2.0° C./minute.

The fired agglomerates were then screened using a 70 mesh screen for 9 mil random and 40 mesh for 14 mil flat top. The agglomerates were coated with a silane solution, made by mixing 1.0 gram A-1100 and 99.0 grams tap water, to provide increased adhesion to the epoxy resin system. The agglomerates were wetted with the silane solution and the excess poured off. The treated agglomerates were then placed in a 90° C. oven for 30 minutes, and again screened.

Test Procedure V

Examples 15–20 and Comparative Examples E–H

Examples 15–20 and Comparative Examples E–H were tested on the Rotary Polisher using the CPP Test Procedure, described earlier. The sample abrasive article was mounted on a 1400 mm curvature dome. The abrasive article and a support pad were attached to the dome with a hook and loop attachment system. The CRT screens tested were 43 cm (17 inches) in diagonal.

The abrasive article and the CRT screen were rotated in opposite directions at an interface pressure of about 0.4 kg/cm$^2$ to 2 kg/cm$^2$. Preferred speed was 700 rpm for the abrasive article and 45 rpm for the screen. A lubricant ("K-40" from LOH Optical Machinery, Milwaukee/Germantown, Wis.) was mixed with tap water to form a 4% solution; this lubricant solution was pumped through the center of the abrasive article at 20 liters/min (6 gal/min).

TABLE 24

| Test Results Using Water and Lubricant as Coolant (at testing pressure of 0.81 kg/cm$^2$) | | | |
|---|---|---|---|
| Example | Diamond Size (μm) | Stock Removal Rate (g/30 s) With Water | Stock Removal Rate (g/30 s) With 4% K-40 Lubricant |
| Comparative E | 50 | 61 | 90 |
| Comparative F | 25 | 25 | 40 |
| Comparative G | 20 | 17 | 27 |
| Comparative H | 15 | 11 | 17 |

TABLE 25

| Test Results Comparing G-Ratios for Water and Lubricant as Coolant | | | |
|---|---|---|---|
| Diamond Size (μm) | Example | Coolant Used | G-Ratio |
| 50 | Comp. E | W | 10 |
| 50 | Comp. E | L | 20 |
| 25 | Comp. F | W | 8 |
| 25 | Comp. F | L | 16 |

W = water
L = 4 wt-% KOH

Tables 24 and 25 show how lubricant can improve the performance of the abrasive article if used as collant instead of water. The lubricant can improve the performance of the abrasive article in two ways. As seen from Table 24, the presence of lubricant improves the stock removal rate for each of the examples up to 50%. In Table 25, using lubricant instead of water improved the G ratio by a factor of two.

TABLE 26

Test Results of Comparative Examples E–H and Examples 17–20.

| Sample | Diamond Size (micrometers) | Stock Removal Rate (g/30 s) With Lubricant |
|---|---|---|
| Comp. Example E | 50 | 90 |
| Example 17 | 50 | 264 |
| Comp. Example F | 25 | 40 |
| Example 18 | 25 | 120 |
| Comp. Example G | 20 | 27 |
| Example 19 | 20 | 78 |
| Comp. Example H | 15 | 17 |
| Example 20 | 15 | 60 |

TABLE 27

Test Results of Comparative Example F and Examples 15, 16, and 18.

| Sample | Agglomerate Concentration | Coolant used | G* Ratio |
|---|---|---|---|
| Comp. Example F | 2.89% | 4% K-40 | 16 |
| Example 15 | 5.65% | 4% K-40 | 50 |
| Example 16 | 25% | 4% K-40 | 300 |
| Example 18 | 60% | 4% K-40 | 1500 |

Tables 26 and 27 show two advantages of the invention. As seen from data in Table 26, by increasing the agglomerate concentration and thus the diamond concentration, the stock removal rate increases by more than 100%. This is true for all diamond sizes. Secondly, as seen from data in Table 27, increasing the agglomerate concentration and the diamond concentration reduces the wear rate significantly. The G ratio for Example 18 increases from 16 to 1500 by increasing the agglomerate concentration from 2.89 wt-% to 60 wt-%.

Examples 17–26

Examples 17–20, with diamond agglomerates, are described above. Examples 21–26, with agglomerates having diamond and aluminum oxide particles, are described below.

TABLE 28

| | Formulations (parts by wt) for Abrasive Slurry for Examples 21–26 | | | | | |
|---|---|---|---|---|---|---|
| | Ex. 21 | Ex. 22 | Ex. 23 | Ex. 24 | Ex. 25 | Ex. 26 |
| Part A Comp. | | | | | | |
| EPO | 29.30 | 29.30 | 29.30 | 29.30 | 29.30 | 29.30 |
| URE | 1.58 | 1.58 | 1.58 | 1.58 | 1.58 | 1.58 |
| CMSK | 0 | 0 | 0 | 0 | 0 | 0 |
| AER | 0.32 | 0.32 | 0.32 | 0.32 | 0.32 | 0.32 |
| APS | 0.32 | 0.32 | 0.32 | 0.32 | 0.32 | 0.32 |
| TFS | 0.06 | 0.06 | 0.06 | 0.06 | 0.06 | 0.06 |
| Part B Comp. | | | | | | |
| ETH | 7.25 | 7.25 | 7.25 | 7.25 | 7.25 | 7.25 |
| RIO | 0.04 | 0.04 | 0.04 | 0.04 | 0.04 | 0.04 |

TABLE 28-continued

| | Formulations (parts by wt) for Abrasive Slurry for Examples 21–26 | | | | | |
|---|---|---|---|---|---|---|
| | Ex. 21 | Ex. 22 | Ex. 23 | Ex. 24 | Ex. 25 | Ex. 26 |
| CMSK | 0 | 0 | 0 | 0 | 0 | 0 |
| CaCO3 | 0 | 0 | 0 | 0 | 0 | 0 |
| AER | 0.80 | 0.80 | 0.80 | 0.80 | 0.80 | 0.80 |
| APS | 0.29 | 0.29 | 0.29 | 0.29 | 0.29 | 0.29 |
| TFS | 0.04 | 0.04 | 0.04 | 0.04 | 0.04 | 0.04 |
| Part C Comp. | 14% | | | | | |
| Agglom. Batch 9 | 60 | / | / | / | / | / |
| Agglom. Batch 10 | / | 60 | / | / | / | / |
| Agglom. Batch 11 | / | / | 60 | / | / | / |
| Agglom. Batch 12 | / | / | / | 60 | / | / |
| Agglom. Batch 13 | / | / | / | / | 60 | / |
| Agglom. Batch 14 | / | / | / | / | / | 60 |

Examples 21–26 were prepared as for Examples 15–20, except using the ingredients of Tables 28; the same backing formulation as in Table 22 was used. The aluminum oxide particles in each example had a slightly smaller average particle size than the diamond particles.

Each of Examples 21–26 was made from the same formulation, which included 60% agglomerates, except that different sized diamonds were in the agglomerates. For Example 21, Agglomerate Batch 9 was used; for Example 22, Agglomerate Batch 10 was used; for Example 23, Agglomerate Batch 11 was used; and for Example 24, Agglomerate Batch 12 was used; for Example 25, Agglomerate Batch 13 was used; and for Example 26, Agglomerate Batch 14 was 10 used. The Agglomerate Batches were made as per Table 29.

TABLE 29

Formulations for Diamond Agglomerate Batches 9-14

| Component | Agglomerate Batch 9 (g) | Agglomerate Batch 10 (g) | Agglomerate Batch 11 (g) | Agglomerate Batch 12 (g) | Agglomerate Batch 13 (g) | Agglomerate Batch 14 (g) |
|---|---|---|---|---|---|---|
| DEX | 30 | 30 | 30 | 30 | 30 | 30 |
| Water | 50 | 50 | 50 | 50 | 50 | 50 |
| GP | 45.5 | 45.5 | 45.5 | 45.5 | 45.5 | 45.5 |
| SIL | 0.7 | 0.7 | 0.7 | 0.7 | 0.7 | 0.7 |
| DIA | 20 (50 μm) | 20 (25 μm) | 20 (20 μm) | 20 (15 μm) | 20 (45 μm) | 20 (6 μm) |
| Al2O3 | 30 | 30 | 30 | 30 | 30 | 30 |
| Agglomerate Size | 355 μm | 225 μm | 225 μm | 225 μm | 355 μm | 225 μm |

TABLE 30

Construction of Comparative Examples E–H and Examples 17–24

| Example | Agglomerate Structure (ratios) | Abrasive Article Structure |
|---|---|---|
| Comp. E, F, G, H | glass:diamond 1:1 | 2.8% agglomerates (1.4% diamond) |

TABLE 30-continued

Construction of Comparative Examples E–H and Examples 17–24

| Example | Agglomerate Structure (ratios) | Abrasive Article Structure |
|---|---|---|
| 17–20 | glass:diamond 1:1 | 60% agglomerates (30% diamond) |
| 21–24 | glass:$Al_2O_3$:diamond 5:3:2 | 60% agglomerate (12% diamond) |

Various examples were tested on the Rotary Polisher using the CPP Test Procedure.

TABLE 31

Test Results Using $Al_2O_3$ and Diamond in Agglomerates Compared to Diamond

| Diamond Size (μm) | Stock Removal Rate (g/30 seconds) Without $Al_2O_3$ | Stock Removal Rate (g/30 seconds) With $Al_2O_3$ |
|---|---|---|
| 50 | 264 (Example 17) | 300 (Example 21) |
| 25 | 120 (Example 18) | 135 (Example 22) |
| 20 | 78 (Example 19) | 102 (Example 23) |
| 15 | 60 (Example 20) | 90 (Example 24) |

Table 31 shows an advantage of the presence of another abrasive particle in the agglomerate in addition to diamond particles. Examples 21–24 used aluminum oxide in addition to diamond in the agglomerates as described in Table 30. As seen in Table 31, the stock removal rate for abrasive articles using aluminum oxide in the agglomerates was 10%–75% higher than the stock removal rate for abrasive articles using the same agglomerate concentration which does not use aluminum oxide in agglomerates. This was true for all diamond sizes.

Examples 21–26 were tested according to the CPP Test Procedure. The testing was done with either water or 4 wt-% K-40 lubricant as the coolant, and at various pressures. The flow rate for the lubricant was 20 liters/minute (6 gal/min). The results are provided in Tables 32–34.

TABLE 32

Stock Removal Rates (g/30 sec) for Examples 21–25 Tested with LOH Lubricant at Various Grinding Pressures

| Example | Diamond Size (μm) | Pressure (kg/cm$^2$) | Stock Removal |
|---|---|---|---|
| 21 | 50 | 0.45 | 190 |
| 21 | 50 | 0.63 | 241 |
| 21 | 50 | 0.81 | 300 |
| 22 | 25 | 0.45 | 88 |
| 22 | 25 | 0.63 | 106 |
| 22 | 25 | 0.81 | 135 |
| 23 | 20 | 0.45 | 70 |
| 23 | 20 | 0.63 | 88 |
| 23 | 20 | 0.81 | 106 |
| 24 | 15 | 0.45 | 66 |
| 24 | 15 | 0.63 | 81 |
| 24 | 15 | 0.81 | 90 |
| 25 | 6 | 0.45 | 18 |
| 25 | 6 | 0.63 | 25 |
| 25 | 6 | 0.81 | 32 |

TABLE 33

G-Ratios

| Diamond Size (μm) | Example | Coolant Used | G-Ratio |
|---|---|---|---|
| 50 | Comp. E | W | 10 |
| 50 | Comp. E | L | 20 |
| 50 | 17 | L | 3000 |
| 50 | 21 | L | 3000 |
| 25 | Comp. F | W | 8 |
| 25 | Comp. F | L | 16 |
| 25 | 18 | L | 1500 |
| 20 | 21 | L | 1000 |

W = water
L = 4 wt.% K-40

TABLE 34

Surface Finish for Examples 21–25

| Example | Diamond Size (μm) | Average Ra (μm) |
|---|---|---|
| 21 | 50 | 0.9 |
| 22 | 25 | 0.65 |
| 23 | 20 | 0.5 |
| 24 | 15 | 0.4 |
| 25 | 6 | 0.2 |

Examples 23 and 26, with 20 and 45 micrometer diamond particles, were tested on the Rotary Polisher according to the CPP Test Procedure, described above, with the interface pressure provided by either pneumatic load and hydraulic load. The pneumatic load and hydraulic load systems can be removed and replaced as desired.

TABLE 35

Stock Removal Rates (g/30 sec) Under Pneumatic and Hydraulic Loads

| | Example 26–45 micrometer | | Example 23–20 micrometer | |
|---|---|---|---|---|
| Pressure (kg/cm$^2$) | Pneumatic Load | Hydraulic Load | Pneumatic Load | Hydraulic Load |
| 0.45 | 137 | 95 | 70 | 48 |
| 0.63 | 188 | 125 | 88 | 66 |
| 0.81 | 223 | 170 | 106 | — |

The data in Table 35 shows advantages of using a pneumatic system for applying load to the abrasive article as compared to a hydraulic load. The stock removal rate using a pneumatic load is 25–50% higher than the stock removal rate under a hydraulic load. Further, the wear of abrasive article was significantly improved using a pneumatic load instead of the hydraulic load.

The complete disclosures of all patents, patent applications, and publications are incorporated herein by reference as if individually incorporated. Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of grinding a glass surface, the method comprising the steps of:

(a) providing an abrasive article having a working surface, the working surface comprising a plurality of abrasive composites, each of the abrasive composites comprising a plurality of abrasive agglomerates dispersed within an organic binder, the agglomerates comprising a plurality of diamond particles and a plurality of second abrasive particles dispersed within a permanent binder;

(b) contacting a glass surface with the working surface of the abrasive article;

(c) providing a lubricant to interface between the working surface of the abrasive article and the glass surface;

(d) applying pressure to the interface of the working surface and the glass surface using pneumatic pressure; and (e) moving the abrasive article relative to the glass surface to remove stock from the glass surface.

2. The method according to claim 1 wherein the abrasive article further comprises a backing and wherein the abrasive composites are integrally molded to the backing.

3. The method according to claim 1 wherein the second abrasive particles comprise aluminum oxide.

4. The method according to claim 2 wherein the second abrasive particles comprise aluminum oxide.

5. The method according to claim 2 wherein the diamond particles are present in an amount of about 6–30% by weight, the second abrasive particles are present in an amount of about 12–40% by weight, and a combination of the organic resin and permanent binder are present in an amount of about 30–82% by weight.

6. The method according to claim 1 wherein the abrasive article further comprises individual abrasive particles dispersed within the organic binder.

7. The method according to claim 1 wherein the lubricant comprises mineral oil.

8. The method according to claim 1 wherein the glass is a CRT screen.

9. A method of grinding a glass surface, the method comprising the steps of:

(a) providing an abrasive article having a working surface, the working surface comprising a plurality of abrasive composites, each of the abrasive composites comprising a plurality of abrasive agglomerates dispersed within an organic binder, the agglomerates comprising a plurality of diamond particles dispersed within a permanent binder, the diamond particles present in an amount of about 20 to 80 percent by weight of the agglomerates, and the agglomerates present in an amount of about 10 to 80 percent by weight of the abrasive composites;

(b) contacting a glass surface with the working surface of the abrasive article;

(c) providing a lubricant to interface between the working surface of the abrasive article and the glass surface;

(d) applying pressure to the interface of the working surface and the glass surface using pneumatic pressure; and (e) moving the abrasive article relative to the glass surface to remove stock from the glass surface.

10. The method according to claim 9 wherein the abrasive article further comprises a backing and wherein the abrasive composites are integrally molded to the backing.

11. The method according to claim 9 wherein the abrasive agglomerates comprise a second abrasive.

12. The method according to claim 11 wherein the second abrasive particles comprise aluminum oxide.

13. The method according to claim 9 wherein the abrasive article further comprises individual abrasive particles dispersed within the organic binder.

14. The method according to claim 9 wherein the lubricant comprises mineral oil.

15. The method according to claim 9 wherein the diamond particles are present in the agglomerate in an amount approximately equal to the weight of the permanent binder.

16. The method according to claim 9 wherein the glass is a CRT screen.

* * * * *

UNITED STATES PATENT AND TRADEMARK OFFICE

CERTIFICATE OF CORRECTION

PATENT NO. : 7,044,835 B2
APPLICATION NO. : 10/284692
DATED : May 16, 2006
INVENTOR(S) : Ashu N. Mujumdar It is certified that error appears in the above-identified patent and that said Letters Patent is hereby corrected as shown below:

Column 3
Line 49, after "35%" insert --.--

Column 8
Line 44, delete "$D_T$of" and insert --$D_T$ of--
Line 47, delete "$D_T$may" and insert --$D_T$ may--
Line 50, delete "$D_T$is" and insert --$D_T$ is--
Line 60, delete "cross section" and insert --cross-section--

Column 9
Line 26, delete "su" and insert --so--
Lines 50-51, delete "trifinctional" and insert --trifunctional--

Column 17
Line 12, after "it is" delete ","

Column 18
Line 9, delete "photosdnsitizers" and insert --photosensitizers--

Column 32
Line 40, delete "of" and insert --for--

Column 38
Line 67; delete "collant" and insert --coolant--

Column 39
Line 5, delete "G ratio" and insert --G-ratio--
Line 39., delete "G ratio" and insert --G-ratio--

UNITED STATES PATENT AND TRADEMARK OFFICE

CERTIFICATE OF CORRECTION

PATENT NO. : 7,044,835 B2
APPLICATION NO. : 10/284692
DATED : May 16, 2006
INVENTOR(S) : Ashu N. Mujumdar It is certified that error appears in the above-identified patent and that said Letters Patent is hereby corrected as shown below:

Column 40
Line 39, after "was" delete "10"
Line 55, delete "Al2O3" and insert --$Al_2O_3$--

Signed and Sealed this

Tenth Day of April, 2007

JON W. DUDAS
*Director of the United States Patent and Trademark Office*